US007587867B2

(12) United States Patent
Weber

(10) Patent No.: US 7,587,867 B2
(45) Date of Patent: Sep. 15, 2009

(54) BUILDING WITH A ROOF HAVING A WIND DEFLECTION SYSTEM

(75) Inventor: Lind Weber, P.O. Box 103, Mitchell, GA (US) 30820

(73) Assignee: Lind Weber, Mitchell, GA (US)

( * ) Notice: Subject to any disclaimer, the term of this patent is extended or adjusted under 35 U.S.C. 154(b) by 360 days.

(21) Appl. No.: 11/491,613

(22) Filed: Jul. 24, 2006

(65) Prior Publication Data

US 2008/0016790 A1 Jan. 24, 2008

(51) Int. Cl.
*E06B 3/16* (2006.01)

(52) U.S. Cl. ..... 52/202; 52/84; 52/24; 52/18; 52/90.1; 52/90.2

(58) Field of Classification Search ..... 52/18, 52/84, 24–26, 90.1, 90.2, 519, 537, 553, 52/556

See application file for complete search history.

(56) References Cited

U.S. PATENT DOCUMENTS 3,583,113 A * 6/1971 Winski ..... 52/144
3,792,728 A * 2/1974 Bernardi ..... 165/47
6,148,570 A * 11/2000 Dinwoodie et al. ..... 52/173.3
6,397,527 B1 * 6/2002 Pellock ..... 52/90.1
6,606,828 B1 * 8/2003 Lin et al. ..... 52/58
7,104,020 B1 * 9/2006 Suttle ..... 52/551
2004/0045231 A1 * 3/2004 Madden ..... 52/202
2004/0177582 A1 * 9/2004 Adriaansen ..... 52/537
2007/0125007 A1 * 6/2007 Alarcon ..... 52/25

FOREIGN PATENT DOCUMENTS

WO WO 8505395 A1 * 12/1985

* cited by examiner

*Primary Examiner*—Richard E Chilcot, Jr.
*Assistant Examiner*—Alp Akbasli
(74) *Attorney, Agent, or Firm*—Nils H. Ljungman & Associates

(57) ABSTRACT

A building with a roof having a wind deflection system. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

20 Claims, 19 Drawing Sheets

BUILDING WITH A ROOF HAVING A WIND DEFLECTION SYSTEM

BACKGROUND

1. Technical Field

Building with a roof having a wind deflection system.

2. Background Information

The vast number of buildings now built in highly exposed regions and the apparently increasing frequency of category 4 and 5 hurricanes all portend more widespread destruction of houses and other buildings. Much of the destruction is needless. The loss of roofs in particular, with collateral damage to life and property, may be preventable.

Many houses and other small buildings in the Caribbean and the U.S. "Hurricane Belt" can lose their roofs to category 3 and 4 storms. Weaknesses are common in the tie-down of roof structure to the walls below, and are also found in the inadequacy of the roof framing itself to withstand hurricane uplift forces without breaking.

Several regions now require resistance to category 5 storms for new construction, and a method of fastening roof structure to exterior wall structure by means of steel straps may be completed during construction. However, there are millions of houses and other low-rise buildings completed without such fastenings or other adequate reinforcement, and the job of "retrofitting" such buildings with steel strap or such devices intended for new construction tends to be disruptive and expensive, even perilous, because trim, soffits, claddings and sheathings may first have to be removed, technicians often working by ladder from the exterior of the building, to access and secure the structural components, after which the whole must be "made good". Several other such retrofit measures are essentially cable or strap arrangements or nets that usually must be skillfully applied to or over the roof each time a storm is anticipated and removed and safely stored after it's over. There is a need for providing a more efficient and less expensive method for protecting buildings, particularly existing buildings and more particularly their roofs, against hurricane force winds.

In aerodynamics there generally are two types of flow around an object: laminar and turbulent. Laminar flow is generally believed to have less drag, but it may also be prone to a phenomenon called "separation." Once the separation of a laminar boundary layer occurs, drag rises dramatically because of eddies that form in the gap. Turbulent flow has more drag initially, but also has better adhesion, and therefore is less prone to "separation." Therefore, if the shape of an object is such that separation occurs easily, it is believed to be better to turbulate the boundary layer in order to increase adhesion and reduce eddies (which may mean a significant reduction in drag). For example, dimples on golf balls turbulate the boundary layer thereabout, as do vortex generators on airplane wings.

OBJECT OR OBJECTS

An object of the embodiments is to reduce roof damage during high winds.

SUMMARY

The present embodiments relate to methods of protecting roofs of buildings during high wind situations. More particularly, these embodiments describe a wind deflection system that may assist in creating turbulent flow, thereby hopefully reducing the laminar flow believed to be largely responsible for lifting, tearing, or otherwise damaging roofs of buildings during episodes of high winds and, in some cases, even hurricane winds. In at least one possible embodiment, it is believed that a building with a roof having a wind deflection system may be used to possibly reduce the lift factor of high winds and possibly even hurricane winds, thereby possibly resulting in a roof, or at least portions thereof, being less prone to lifting off of a building during periods of high winds.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

DESCRIPTION OF EMBODIMENT OR EMBODIMENTS

Figure 1:
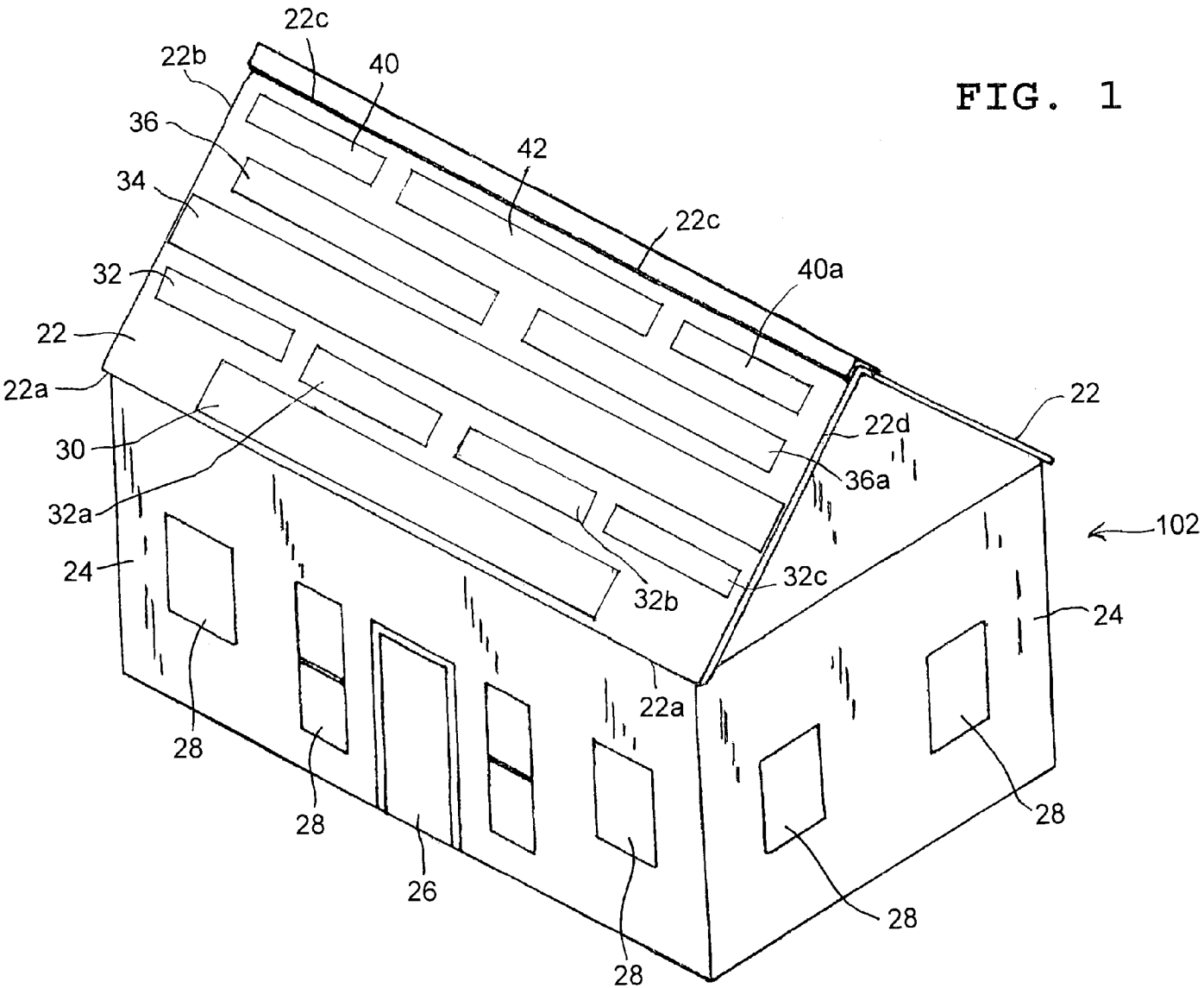
FIG. 1 shows a pitched roof with various horizontal applications of roof protecting elements of different sizes and placements according to one possible embodiment.

The following describes embodiments of a building with a roof having a wind deflection system. In one possible embodiment, it is believed that a building with a roof having a wind deflection system may conceivably be used to possibly reduce the lift factor of high winds and even hurricane winds, thereby possibly resulting in a roof, or at least portions thereof, being less prone to lifting off of a building during periods of high winds. FIGS. 1-4 show examples of buildings with roofs having a wind deflection system. In FIGS. 1-4, various reference numerals are used to indicate various roof protecting elements on a roof. The various numbers are used to indicate the various positions in which one or more roof protecting elements may be placed according to at least one possible embodiment. It should be understood that each of the roof protecting elements shown in FIGS. 1-4 may be of the same design or of different designs. In FIGS. 5-15, various embodiments of a roof protecting element 101 are shown. It should be understood that any one or more of the embodiments of the roof protecting element 101 shown in FIGS. 5-15 may be utilized in any of the embodiments shown in FIGS. 1-4 in any desired configuration. It should further be understood that the various configurations and positions shown in FIGS. 1-4 are for purposes of example and are not intended to limit the possible embodiments described herein to the embodiments shown in FIGS. 1-4.

FIG. 1 shows components of a possible embodiment example of a building with a roof, specifically, a building with a roof having a wind deflection system, in accordance with at least one possible embodiment, in which system could possibly be utilized at least one aspect, or several aspects, of the embodiments disclosed herein.

FIG. 1 shows a building 102 with a door 26, windows 28, walls 24 and a pitched roof 22. A pitched roof 22 is shown to be supported by walls 24 and includes a front longitudinal roof edge 22*a*, side sloped roof edges 22*b* and 22*d*, and a top roof ridge edge 22*c*.

In one possible embodiment, a roof protecting element 30 is shown to have a length and a width measurement, with the length measurement being substantially greater than the width measurement. The roof protecting element 30 is shown to be oriented substantially parallel to and adjacent to the front longitudinal roof edge 22*a* and substantially parallel to the roof ridge edge 22*c*. The roof protecting element 30 is shown to be nearer to the front longitudinal roof edge 22*a* and further from the roof ridge edge 22*c*. The roof protecting element 30 is shown to be substantially perpendicular to and equidistant between side sloped roof edges 22*b* and 22*d*. In other possible examples, the roof protecting element 30 may be placed at an unequal distance between side sloped roof edges 22*b* and 22*d*, with the placement of a roof protecting element nearer to one side sloped roof edge and further from the other side sloped roof edge.

In another possible embodiment, a roof protecting element 32*a* is shown to have a length and a width measurement, with a length measurement being substantially greater than a width measurement. The roof protecting element 32*a* is shown to be oriented substantially parallel to the front longitudinal roof edge 22*a* and the roof ridge edge 22*c*. The roof protecting element 32*a* is shown to be substantially perpendicular to the side sloped roof edge 22*b* and 22*d*, with the placement of the roof protecting element 32*a* nearer to the side sloped roof edge 22*b* and further from the side sloped roof edge 22*d*. The roof protecting element 32*a* is shown to be adjacent to the roof protecting element 32 and 32*b*. The roof protecting element 32*b* is shown to have a length and width measurement, with the length measurement being substantially greater than the width measurement. The roof protecting element 32*b* is shown to be oriented substantially parallel to the front longitudinal roof edge 22*a* and the roof ridge edge 22*c* and is substantially perpendicular to the side sloped roof edge 22*b* and 22*d*. The roof protecting element 32*b* is shown to be nearer to the side sloped roof edge 22*d* and further from the side sloped roof edge 22*b*. The roof protecting element 32*b* is shown to be adjacent to the roof protecting element 32*a* and 32*c*. The roof protecting element 32*c* is shown to have a length and a width measurement, with the length measurement being substantially greater than the width measurement. The roof protecting element 32*c* is shown to be oriented substantially parallel to the front longitudinal roof edge 22*a* and the roof ridge edge 22*c*. The roof protecting element 32*c* is shown to be substantially perpendicular to the side sloped roof edge 22*b* and 22*d*, with the placement of the roof protecting element 32*c* nearer to the side sloped roof edge 22*d* and further from the side sloped roof edge 22*b*. The roof protecting element 32*c* is shown to be adjacent to the roof protecting element 32*b* and the side sloped roof edge 22*d*.

In another possible embodiment, a roof protecting element 34 is shown to have a length and a width measurement, with the length measurement being substantially greater than the width measurement. The roof protecting element 34 is shown to be oriented substantially parallel to the front longitudinal roof edge 22*a* and the roof ridge edge 22*c*. The roof protecting element 34 is shown to be substantially perpendicular and adjacent to the side sloped roof edges 22*b* and 22*d* and is equidistant from each of the side sloped roof edges 22*b* and 22*d*.

In another possible embodiment, a roof protecting element 36 is shown to have a length and width measurement, with the length measurement being substantially greater than the width measurement. The roof protecting element 36 is shown to be oriented substantially parallel to the front longitudinal roof edge 22*a* and the roof ridge edge 22*c*. The roof protecting element 36 is shown to be nearer to the roof ridge edge 22*c* and further from the longitudinal roof edge 22*a* and substantially perpendicular to the side sloped roof edge 22*b* and 22*d*. The roof protecting element 36 is shown to be adjacent to the side sloped roof edge 22*b* and the roof protecting element 36*a*. The roof protecting element 36*a* is shown to have a length and width measurement, with the length measurement being substantially greater than the width measurement. The roof protecting element 36*a* is shown to be oriented substantially parallel to the front longitudinal roof edge 22*a* and the roof ridge edge 22*c*. The roof protecting element 36*a* is shown to be nearer to the roof ridge edge 22*c* and further from the longitudinal roof edge 22*a* and substantially perpendicular to the side sloped roof edges 22*b* and 22*d*. The roof protecting element 36*a* is shown to be adjacent to the side sloped roof edge 22*d* and the roof protecting element 36.

In another possible embodiment, a roof protecting element 40 is shown to have a length and width measurement, with the length measurement being substantially greater than the width measurement. The roof protecting element 40 is shown to be oriented substantially parallel and adjacent to the roof ridge edge 22*c* and substantially parallel to the front longitudinal roof edge 22*a*. The roof protecting element 40 is shown to be nearer to the roof ridge edge 22*c* and further from the front longitudinal roof edge 22*a*. The roof protecting element 40 is shown to be substantially perpendicular to and adjacent to the side sloped roof edge 22*b* and the roof protecting element 42. The roof protecting element 42 is shown to have a length and width measurement, with the length measurement being substantially greater than the width measurement. The roof protecting element 42 is shown to be oriented substantially parallel and adjacent to the roof ridge edge 22*c* and substantially parallel to the front longitudinal roof edge 22*a*. The roof protecting element 42 is shown to be substantially perpendicular to and equidistant between the side sloped roof edges 22*b* and 22*d*. The roof protecting element 42 is shown to be substantially perpendicular to and adjacent to the roof protecting element 40*a*. The roof protecting element 40*a* is shown to have a length and width measurement, with the length measurement being substantially greater than the width measurement. The roof protecting element 40*a* shown to be oriented substantially parallel and adjacent to the roof ridge edge 22*c* and substantially parallel to the front longitudinal roof edge 22*a*. The roof protecting element 40*a* is shown to be nearer to the roof ridge edge 22*c* and further from the front longitudinal roof edge 22*a*. The roof protecting element 40*a* is shown to be substantially perpendicular to and adjacent to the side sloped roof edge 22*d* and the roof protecting element 42.

In other possible embodiments, one or more of the roof protecting elements 30, 32, 32*a-d*, 34, 36, 36*a*, 40, 42 and/or 42*a* may be used in several or a multiplicity of locations and in several or a multiplicity of combinations on the roof 22. In other possible embodiments, one or more of the roof protecting elements 30, 32, 32*a-d*, 34, 34*a*, 36, 36*a*, 40, 40*a*, and/or 42 may be duplicated and used repeatedly in several or a multiplicity of locations on the roof 22, or only one roof protecting element may be used. In other possible embodiments, one or more of the roof protecting elements 30, 32, 32*a-d*, 34, 34*a*, 36, 36*a*, 40, 40*a*, and/or 42 may be used in several or a multiplicity of length measurements and/or several or a multiplicity of width measurements on the roof 22, or the same length and width measurements may be used repeatedly.

Figure 2:
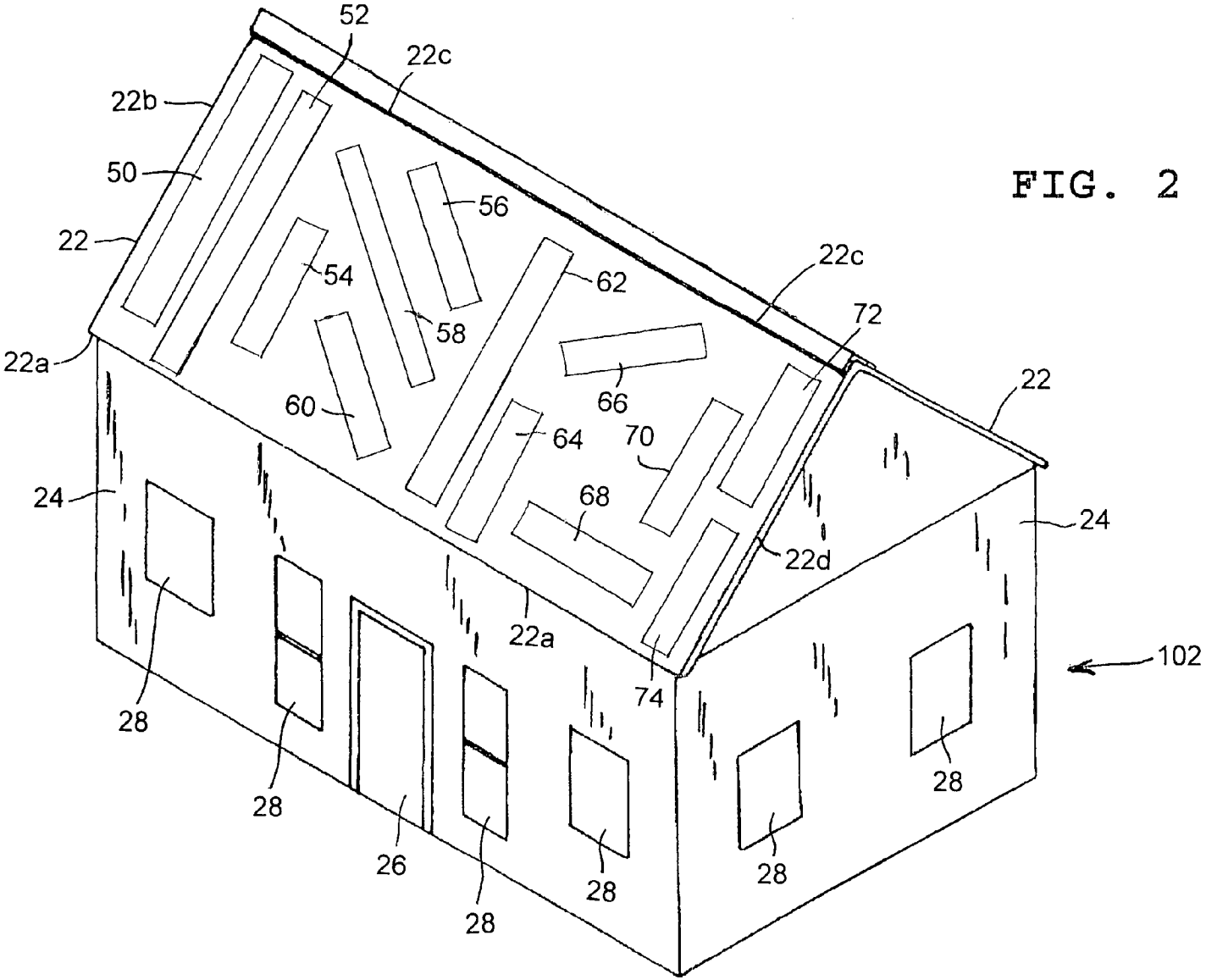
FIG. 2 shows a pitched roof with various horizontal, diagonal, and vertical applications of roof protecting elements according to one possible embodiment.

FIG. 2 shows the main components of one possible embodiment of a building with a roof, specifically, a building with a roof having a wind deflection system, in accordance with at least one possible embodiment, in which system could possibly be utilized at least one aspect, or several aspects, of the embodiments disclosed herein.

FIG. 2 shows a building 102 with a door 26, windows 28, walls 24 and a pitched roof 22. The pitched roof 22 is shown to be supported by walls 24 and includes a front longitudinal roof edge 22*a*, a side sloped roof edge 22*b* and 22*d*, and top roof ridge edge 22*c*.

In one possible embodiment, a roof protecting element 50 is shown to have a length and a width measurement, with the length measurement being substantially greater than the width measurement. The roof protecting element 50 is shown to be oriented substantially perpendicular to the front longitudinal roof edge 22*a* and the roof ridge edge 22*c*. The roof protecting element 50 is shown to be substantially parallel to the side sloped roof edge 22*b* and 22*d*, with the placement of the roof protecting element 50 nearer to the side sloped roof edge 22*b* and further from the side sloped roof edge 22*d*. The roof protecting element 50 is shown to be substantially adjacent to and equidistant from the side sloped roof edge 22*b* and the roof protecting element 52. The roof protecting element 52 is shown to have a length and width measurement, with the length measurement being substantially greater than the width measurement. The roof protecting element 52 is shown to be oriented substantially perpendicular to the front longitudinal roof edge 22*a* and the roof ridge edge 22*c* and is substantially parallel to and nearer to the side sloped roof edge 22*b* and further from the side sloped roof edge 22*d*.

In another possible embodiment, a roof protecting element 54 is shown to have a length and a width measurement, with the length measurement being substantially greater than the width measurement. The roof protecting element 54 is shown to be adjacent to the roof protecting element 52 and is shown to be oriented substantially perpendicular to the front longitudinal roof edge 22*a* and the roof ridge edge 22*c*. The roof protecting element 54 is shown to be nearer to the front longitudinal roof edge 22*a* and further from the roof ridge edge 22*c*. The roof protecting element 54 is shown to be substantially parallel to the side sloped roof edge 22*b* and 22*d*, with the placement of the roof protecting element 54 nearer to the side sloped roof edge 22*b* and further from the side sloped roof edge 22*d*.

In another possible embodiment, a roof protecting element 56 is shown to have a length and a width measurement, with the length measurement being substantially greater than the width measurement. The roof protecting element 56 is shown to be oriented not substantially perpendicular to and not substantially parallel to the front longitudinal roof edge 22*a*, the roof ridge edge 22*c*, and each of the side sloped roof edge 22*b* and 22*d*. The length dimension of the roof protecting element 56 is shown to be at an approximate 45-degree angle with respect to the roof ridge edge 22*c*. Other possible embodiments may position the length dimension of the roof protecting element 56 at any number of degrees angled with respect to the roof ridge edge 22*c*. Other possible embodiments may position the length dimension of the roof protecting element 56 at any number of 1-degree increments larger than zero degrees and less than ninety degrees with respect to the roof ridge edge 22*c*. The roof protecting element 56 is shown to be adjacent to the roof ridge edge 22*c* and nearer to the side sloped roof edge 22*b* and further from the side sloped roof edge 22*d*.

In another possible embodiment, a roof protecting element 58 is shown to have a length and a width measurement, with the length measurement being substantially greater than the width measurement. The roof protecting element 58 is shown to be oriented not substantially perpendicular to and not substantially parallel to the front longitudinal roof edge 22*a*, the roof ridge edge 22*c*, and each of the side sloped roof edge 22*b* and 22*d*. The length dimension of the roof protecting element 58 is shown to be at an approximate 45-degree angle with respect to the roof ridge edge 22*c*. Other possible embodiments may position the length dimension of the roof protecting element 58 at any number of degrees angled with respect to the roof ridge edge 22*c*. Other possible embodiments may position the length dimension of the roof protecting element 58 at any number of 1-degree increments larger than zero degrees and less than ninety degrees with respect to the roof ridge edge 22*c*. The roof protecting element 58 is shown to be nearer the roof ridge edge 22*c* and the side sloped roof edge

22*b* and further from the front longitudinal roof edge 22*a* and the side sloped roof edge 22*d*.

In another possible embodiment, a roof protecting element 60 is shown to have a length and a width measurement, with the length measurement being substantially greater than the width measurement. The roof protecting element 60 is shown to be oriented not substantially perpendicular to and not substantially parallel to the front longitudinal roof edge 22*a*, the roof ridge edge 22*c*, and each of the side sloped roof edge 22*b* and 22*d*. The length dimension of the roof protecting element 60 is shown to be at an approximate 45-degree angle with respect to the roof ridge edge 22*c*. Other possible embodiments may position the length dimension of the roof protecting element 60 at any number of degrees angled with respect to the roof ridge edge 22*c*. Other possible embodiments may position the length dimension of the roof protecting element 60 at any number of 1-degree increments larger than zero degrees and less than ninety degrees with respect to the roof ridge edge 22*c*. The roof protecting element 60 is shown to be adjacent the front longitudinal roof edge 22*a* and nearer to the side sloped roof edge 22*b* and further from the side sloped roof edge 22*d*.

In another possible embodiment, a roof protecting element 62 is shown to have a length and a width measurement, with the length measurement being substantially greater than the width measurement. The roof protecting element 62 is shown to be oriented substantially perpendicular to the front longitudinal roof edge 22*a* and the roof ridge edge 22*c*. The roof protecting element 62 is shown to be substantially equidistant from the longitudinal roof edge 22*a* and the roof ridge edge 22*c*. The roof protecting element 62 is shown to be substantially parallel to each of the side sloped roof edge 22*b* and 22*d* and is substantially equidistant from each of the side sloped roof edge 22*b* and 22*d*. The roof protecting element 64 is shown to be adjacent to the roof protecting element 62 and the front longitudinal roof edge 22*a*. The roof protecting element 64 is shown to have a length and width measurement, with the length measurement being substantially greater than the width measurement. The roof protecting element 64 is shown to be oriented substantially perpendicular to the front longitudinal roof edge 22*a* and the roof ridge edge 22*c*. The roof protecting element 64 is shown to be substantially parallel to the roof protecting element 62 and each of the side sloped roof edge 22*b* and 22*d*. The roof protecting element is shown to be nearer to the side sloped roof edge 22*d* and further from the side sloped roof edge 22*b*.

In another possible embodiment, a roof protecting element 66 is shown to have a length and a width measurement, with the length measurement being substantially greater than the width measurement. The roof protecting element 66 is shown to be oriented not substantially perpendicular to and not substantially parallel to the front longitudinal roof edge 22*a*, the roof ridge edge 22*c*, and each of the side sloped roof edge 22*b* and 22*d*. The length dimension of the roof protecting element 66 is shown to be at an approximate 45-degree angle with respect to the roof ridge edge 22*c*. Other possible embodiments may position the length dimension of the roof protecting element 66 at any number of degrees angled with respect to the roof ridge edge 22*c*. Other possible embodiments may position the length dimension of the roof protecting element 66 at any number of 1-degree increments larger than zero degrees and less than ninety degrees with respect to the roof ridge edge 22*c*. The roof protecting element 66 is shown to be adjacent to the roof ridge edge 22*c* and nearer to the side sloped roof edge 22*d* and further from the side sloped roof edge 22*b*.

In another possible embodiment, a roof protecting element 68 is shown to be adjacent to the roof protecting element 64 and the front longitudinal roof edge 22*a*. The roof protecting element 68 is shown to have a length and width measurement, with the length measurement being substantially greater than the width measurement. The roof protecting element 68 is shown to be oriented substantially perpendicular to the roof protecting element 64 and each of the side sloped roof edge 22*b* and 22*d*. The roof protecting element 68 is shown to be nearer to the side sloped roof edge 22*d* and further from the side sloped roof edge 22*b*. The roof protecting element 68 is shown to be substantially parallel to the longitudinal roof edge 22*a* and the roof ridge edge 22*c*.

In another possible embodiment, a roof protecting element 70 is shown to have a length and a width measurement, with the length measurement being substantially greater than the width measurement. The roof protecting element 70 is shown to be oriented substantially perpendicular to the front longitudinal roof edge 22*a* and the roof ridge edge 22*c*. The roof protecting element 70 is shown to be substantially parallel to the side sloped roof edge 22*b* and 22*d*, with the placement of the roof protecting element 70 nearer to the side sloped roof edge 22*d* and further from the side sloped roof edge 22*b*. The roof protecting element 70 is shown to be substantially adjacent to and parallel to the roof protecting element 72 and 74.

In another possible embodiment, a roof protecting element 72 is shown to have a length and width measurement, with the length measurement being substantially greater than the width measurement. The roof protecting element 72 is shown to be adjacent to the roof ridge edge 22*c* and the side sloped roof edge 22*d*. The roof protecting element 72 is shown to be oriented substantially perpendicular to the roof ridge edge 22*c* and the front longitudinal roof edge 22*a* and is substantially parallel to the side sloped roof edge 22*b* and 22*d*. The roof protecting element 72 is shown to be equidistant from the roof protecting element 70 and the side sloped roof edge 22*d*.

In another possible embodiment, a roof protecting element 74 is shown to have a length and width measurement, with the length measurement being substantially greater than the width measurement. The roof protecting element 74 is shown to be adjacent to the front longitudinal roof edge 22*a* and the side sloped roof edge 22*d*. The roof protecting element 74 is shown to be oriented substantially perpendicular to the roof ridge edge 22*c* and the front longitudinal roof edge 22*a* and is substantially parallel to the side sloped roof edge 22*b* and 22*d*.

In other possible embodiments, one or more of the roof protecting elements 50, 52, 54, 56, 58, 60, 62, 64, 66, 68, 70, 72, and/or 74 may be used in several or a multiplicity of locations and in several or a multiplicity of combinations on the roof 22. In other possible embodiments, one or more of the roof protecting elements 50, 52, 54, 56, 58, 60, 62, 64, 66, 68, 70, 72, and/or 74 may be duplicated and used repeatedly, or only one roof protecting element may be used. In other possible embodiments, one or more of the roof protecting elements 50, 52, 54, 56, 58, 60, 62, 64, 66, 68, 70, 72, and/or 74 may be used in several or a multiplicity of length measurements and/or several or a multiplicity of width measurements on the roof 22, or the same length and width measurements may be used repeatedly.

Figure 3:
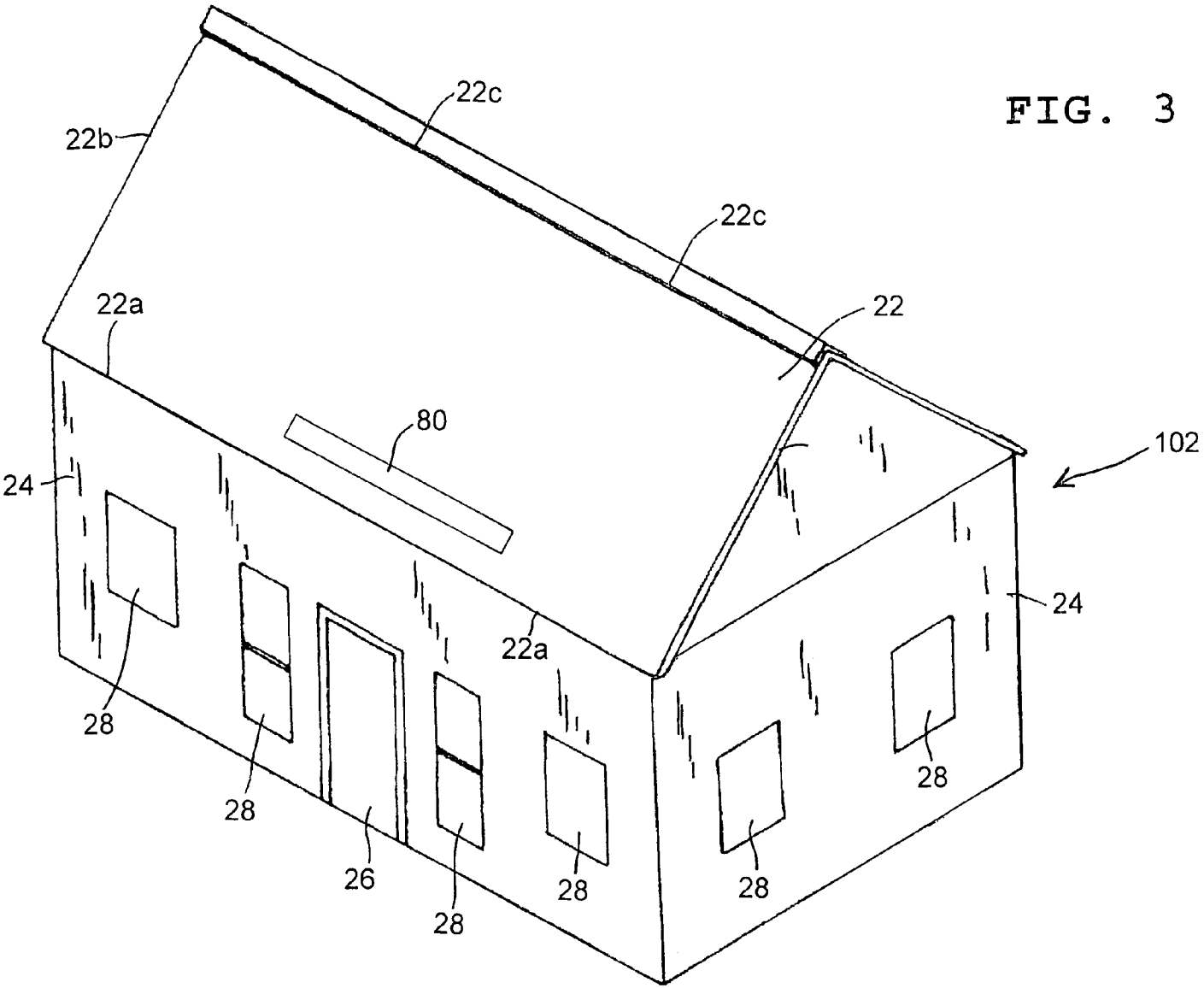
FIG. 3 shows a pitched roof with a horizontal application of a roof protecting element according to one possible embodiment.

FIG. 3 shows the main components of one possible embodiment of a building with a roof, specifically, a building with a roof having a wind deflection system, in accordance with at least one possible embodiment, in which system could possibly be utilized at least one aspect, or several aspects, of the embodiments disclosed herein.

FIG. 3 shows a building 102 with a door 26, windows 28, walls 24 and a pitched roof 22. The pitched roof 22 is shown to be supported by walls 24 and includes a front longitudinal roof edge 22*a,* side sloped roof edges 22*b* and 22*d,* and a top roof ridge edge 22*c*.

In one possible embodiment, a roof protecting element 80 is shown to have a length and a width measurement, with the length measurement being substantially greater than the width measurement. The roof protecting element 80 is shown to be oriented substantially parallel to and adjacent to the front longitudinal roof edge 22*a* and substantially parallel to the roof ridge edge 22*c*. The roof protecting element 80 is shown to be nearer to the front longitudinal roof edge 22*a* and further from the roof ridge edge 22*c*. The roof protecting element 80 is shown to be substantially perpendicular to and equidistant between the side sloped roof edge 22*b* and 22*d*. In other possible embodiments, the roof protecting element 80 may be placed at an unequal distance between the side sloped roof edge 22*b* and 22*d,* with the placement of the roof protecting element nearer to one side sloped roof edge and further from the other side sloped roof edge.

In other possible embodiments, one or more of the roof protecting element 80 may be used in several or a multiplicity of locations and in several or a multiplicity of combinations on the roof 22. In other possible embodiments, one or more of the roof protecting element 80 may be duplicated and used repeatedly, or only one roof protecting element may be used. In other possible embodiments, one or more of the roof protecting element 80 may be used in several or a multiplicity of length measurements and/or several or a multiplicity of width measurements on the roof 22, or the same length and width measurements may be used repeatedly.

Figure 4:
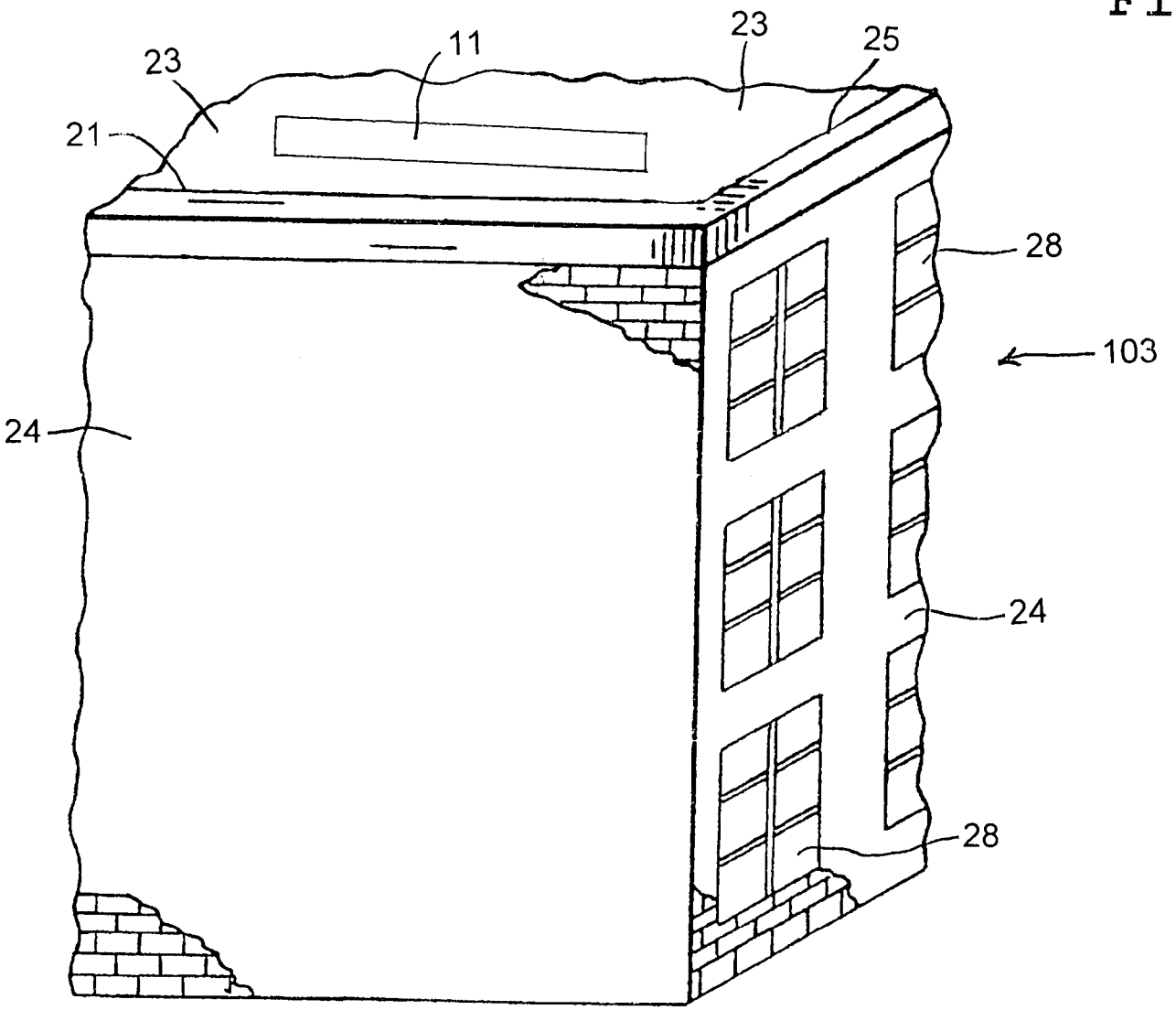
FIG. 4 shows a flat roof with an application of a roof protecting element according to one possible embodiment.

FIG. 4 shows the main components of one possible embodiment of a building with a roof, specifically, a building with a flat roof having a wind deflection system, in accordance with at least one possible embodiment, in which system could possibly be utilized at least one aspect, or several aspects, of the embodiments disclosed herein.

FIG. 4 shows a building 103 with windows 28, walls 24 and a flat roof 23. The flat roof 23 is shown to be supported by walls 24 and includes a front roof edge 21, a side roof edge 25.

In one possible embodiment, a roof protecting element 11 is shown to have a length and a width measurement, with the length measurement being substantially greater than the width measurement. The roof protecting element 11 is shown to be oriented substantially parallel to and adjacent to the front roof edge 21 and substantially perpendicular to the side roof edge 25.

In other possible embodiments, one or more of the roof protecting element 11 may be used in several or a multiplicity of locations and in several or a multiplicity of combinations on the roof 23. In other possible embodiments, one or more of the roof protecting element 11 may be duplicated and used repeatedly, or only one roof protecting element may be used. In other possible embodiments, one or more of the roof protecting element 11 may be used in several or a multiplicity of length measurements and/or several or a multiplicity of width measurements on the roof 23, or the same length and width measurements may be used repeatedly.

Figure 5:
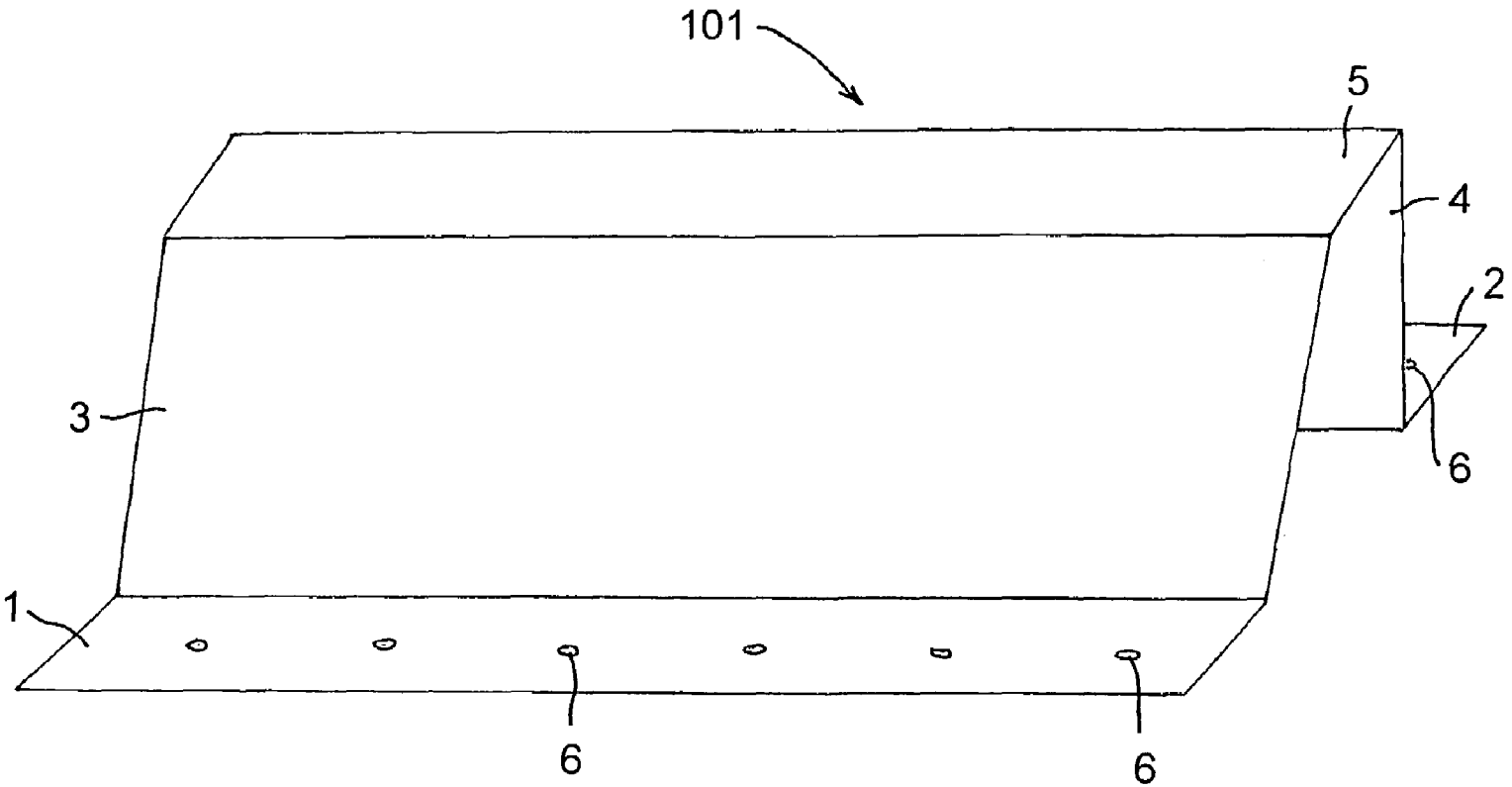
FIG. 5 shows a close-up of a roof protecting element according to one possible embodiment.
Figure 5A:
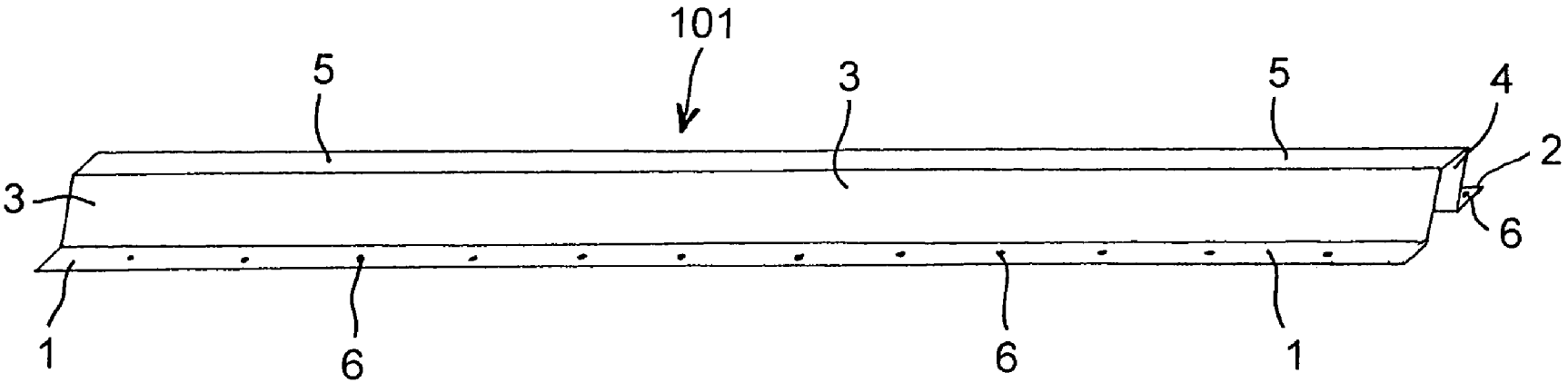
FIG. 5A shows a roof protecting element according to one possible embodiment.

FIGS. 5 and 5A show the main components of one possible embodiment of a roof protecting element 101, specifically, a roof protecting element used as a wind deflection system, in accordance with at least one possible embodiment, in which system could possibly be utilized at least one aspect, or several aspects, of the embodiments disclosed herein.

FIGS. 5 and 5A show the roof protecting element 101 with flanges 1 and 2, inclined face section 3, supporting back section 4, and cover section 5. The cover section 5 is shown to be supported by the face feature 3 and supporting back section 4. The flanges 1 and 2 are shown to have several securing points 6.

In one possible embodiment, flanges 1 and 2, inclined face section 3, supporting back section 4, and cover section 5 of a roof protecting element 101 have a length and a width measurement, with the length measurement being substantially greater than the width measurement.

In one possible embodiment, a length measurement of the flanges 1 and 2, inclined face section 3, supporting back section 4, and cover section 5 of a roof protecting element 101 is approximately eight feet. In other possible embodiments, a length measurement of the flanges 1 and 2, inclined face section 3, supporting back section 4, and cover section 5 may be any number of lengths. In other possible embodiments, a length measurement of the flanges 1 and 2, inclined face section 3, supporting back section 4, and cover section 5 may be any number of 1-inch increments larger than twelve inches and less than twenty feet.

In one possible embodiment, a width measurement of flanges 1 and 2 and a cover section 5 of a roof protecting element 101 is approximately two inches.

In other possible embodiments, the width measurement of the flanges 1 and 2 and the cover section 5 may be any number of widths. In other possible embodiments, the width measurement of the flanges 1 and 2 and the cover section 5 may be approximately any number of one thirty-second of an inch increments larger than zero inches and less than twelve inches.

In one possible embodiment, the width measurement of the inclined face section 3 of the roof protecting element 101 is approximately five and one half inches and the supporting back section 4 of the roof protecting element 101 is approximately four and one half inches.

In other possible embodiments, the width measurement of the inclined face section 3 and the supporting back section 4 may be any number of widths. In other possible embodiments, the width measurement of the inclined face section 3 and the supporting back section 4 may be approximately any number of one thirty-second of an inch increments larger than two inches and less than twelve inches.

In other possible embodiments, one or more of the flanges 1 and 2, inclined face section 3, supporting back section 4, and cover section 5 of the roof protecting element 101 may be used in several or a multiplicity of length measurements and/or several or a multiplicity of width measurements, or the same length and width measurements may be used repeatedly.

In one possible embodiment, the securing point 6 is the site at which the roof protecting element 101 may be attached to the roof of a building.

In one possible embodiment, the roof protecting element 101 is constructed or fashioned out of sheet metal. In other possible embodiments, the roof protecting element 101 may be constructed or fabricated out of numerous sheet metal materials. In other possible embodiments, the roof protecting element 101 may be constructed or fabricated out of painted sheet metal, vinyl or plastic-coated sheet metal, and/or textured sheet metal.

Figure 6:
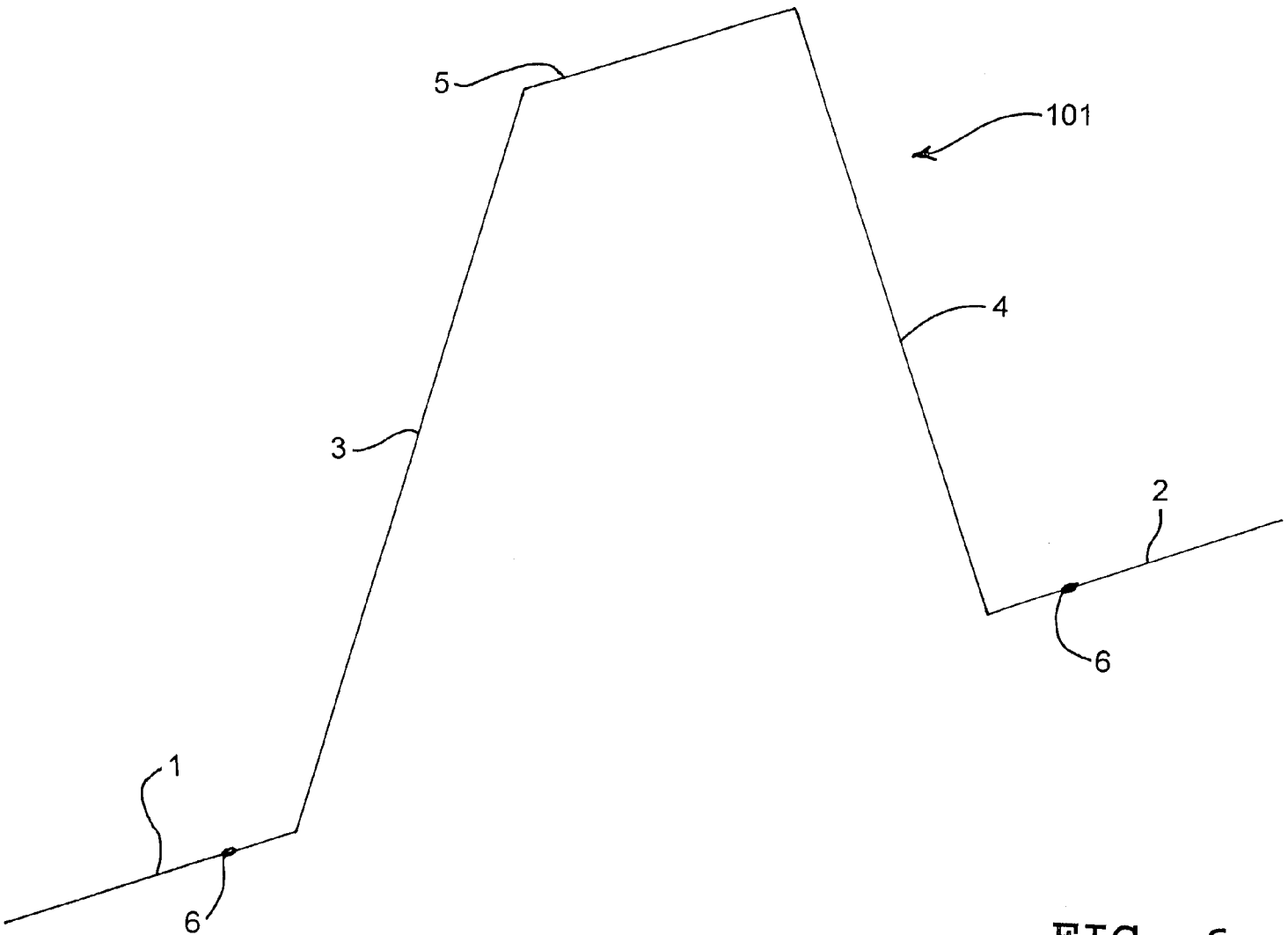
FIG. 6 shows a cross-section of an angular roof protecting element according to one possible embodiment.
Figure 7:
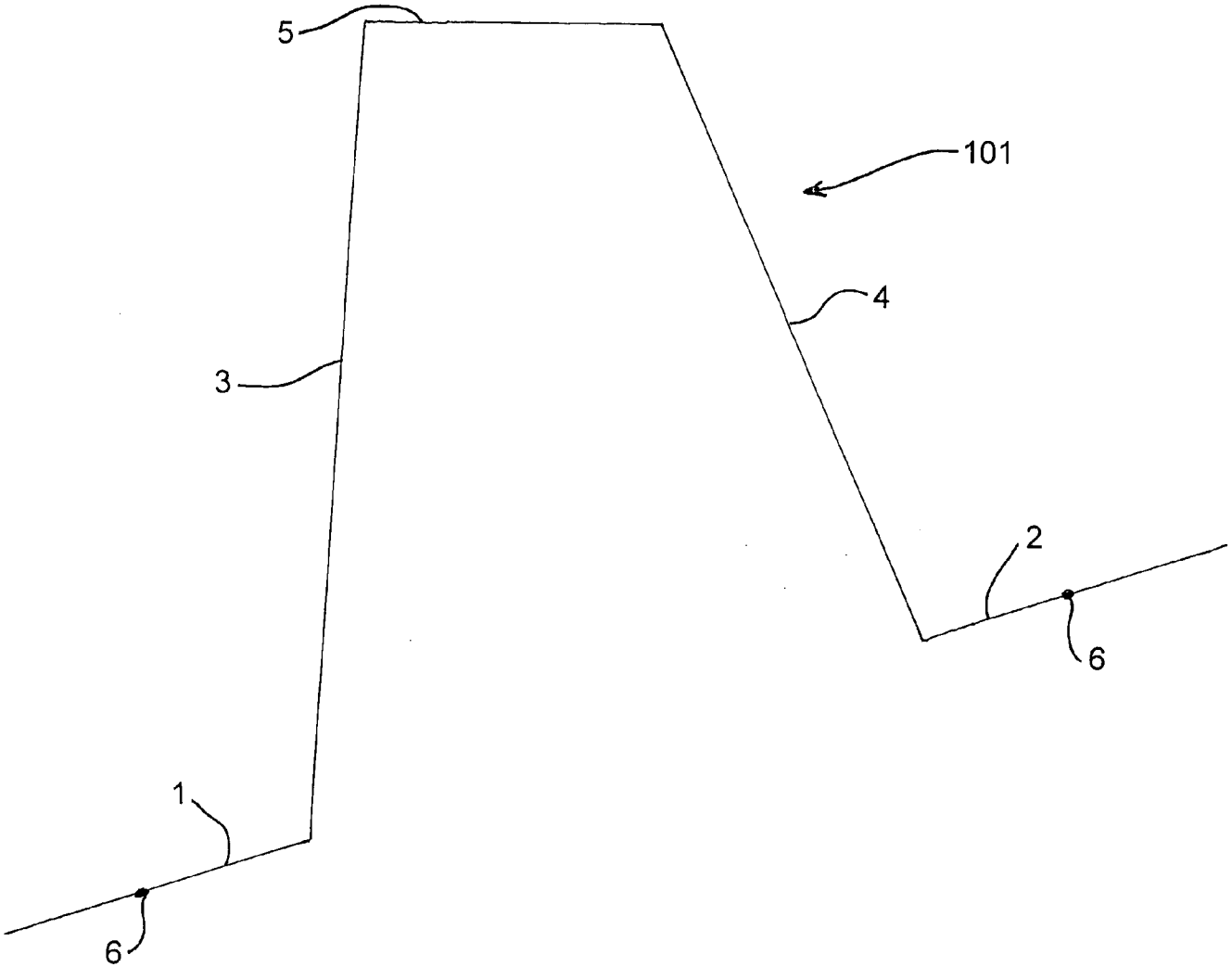
FIG. 7 shows a cross-section of an angular roof protecting element according to one possible embodiment.
Figure 8:
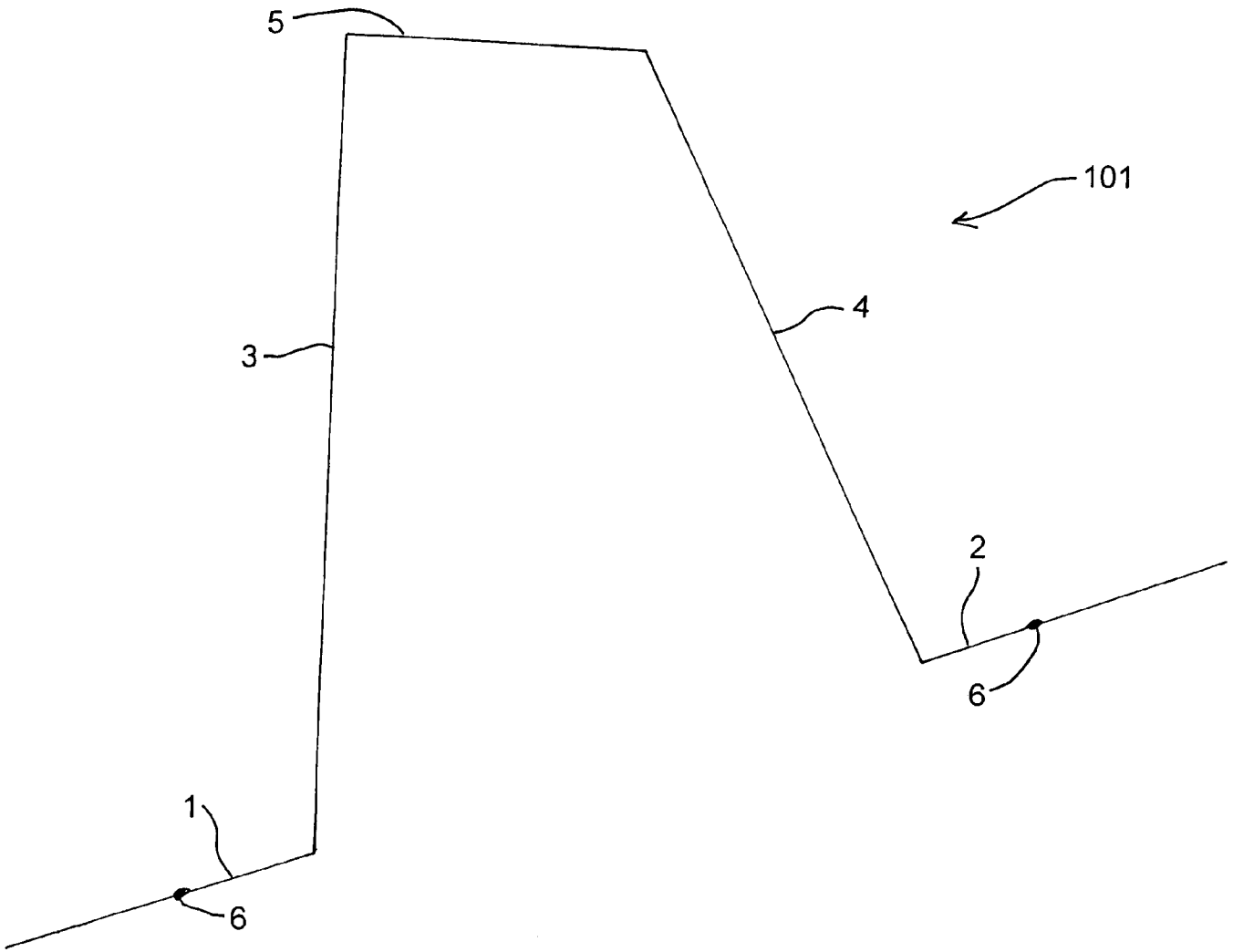
FIG. 8 shows a cross-section of an angular roof protecting element according to one possible embodiment.

FIGS. 6, 7, and 8 show a cross section of the main components of one possible embodiment of a roof protecting element, specifically, a roof protecting element used as a wind deflection system, in accordance with at least one possible embodiment, in which system could possibly be utilized at least one aspect, or several aspects, of the embodiments disclosed herein.

FIGS. 6, 7, and 8 show a roof protecting element 101 with flanges 1 and 2, inclined face section 3, supporting back section 4, and cover section 5. In FIGS. 6, 7, and 8 the cover section 5 is shown to be supported by the face feature 3 and supporting back section 4, and the flanges 1 and 2 are shown to have securing point 6.

In FIGS. 6, 7, and 8 the width dimension of the inclined face section 3 is shown to be at an approximate obtuse angle with respect to the width dimension of the flange 1. Other possible embodiments may position the width dimension of the inclined face section 3 at any number of degrees angled with respect to the width dimension of the flange 1. Other possible embodiments may position the width dimension of the inclined face section 3 at any number of 1-degree increments larger than 90 degrees and less than 180 degrees with respect to the width dimension of the flange 1.

In FIG. 6, the width dimension of the inclined face section 3 is shown to be at an approximate obtuse angle with respect to the width dimension of the cover section 5. Other possible embodiments may position the width dimension of the inclined face section 3 at any number of degrees angled with respect to the width dimension of the cover section 5. Other possible embodiments may position the width dimension of the inclined face section 3 at any number of 1-degree increments larger than 90 degrees and less than 180 degrees with respect to the width dimension of the cover section 5.

In FIGS. 7 and 8, the width dimension of the inclined face section 3 is shown to be at an approximate acute angle with respect to the width dimension of the cover section 5. Other possible embodiments may position the width dimension of the inclined face section 3 at any number of degrees angled with respect to the width dimension of the cover section 5. Other possible embodiments may position the width dimension of the inclined face section 3 at any number of 1-degree increments larger than zero degrees and less than ninety degrees with respect to the width dimension of the cover section 5.

In FIG. 6, the width dimension of the supporting back section 4 is shown to be at an approximate 90-degree angle with respect to the width dimension of the flange 2 and the width dimension of the cover section 5. Other possible embodiments may position the width dimension of the supporting back section 4 at any number of degrees angled with respect to the width dimension of the flange 2 and the width dimension of the cover section 5. Other possible embodiments may position the width dimension of the supporting back section 4 at any number of 1-degree increments larger than forty-five degrees and less than one hundred and thirty-five degrees with respect to the width dimension of the cover section 5.

In FIGS. 7 and 8, the width dimension of the supporting back section 4 is shown to be at an approximate obtuse angle with respect to the width dimension of the flange 2 and the width dimension of the cover section 5. Other possible embodiments may position the width dimension of the supporting back section 4 at any number of degrees angled with respect to the width dimension of the flange 2 and the width dimension of the cover section 5. Other possible embodiments may position the width dimension of the supporting back section 4 at any number of 1-degree increments larger than ninety degrees and less than one hundred and eighty degrees with respect to the width dimension of the flange 2 and the width dimension of the cover section 5.

In other possible embodiments, one or more of width dimensions of the flanges 1 and 2, inclined face section 3, supporting back section 4, and cover section 5 of the roof protecting element 101 may be used in several or a multiplicity of angles with respect to each of the other components of the roof protecting element 101, or the same angles may be used repeatedly.

In one possible embodiment, the securing point 6 is the site at which the roof protecting element 101 may be attached to the roof of a building.

Figure 9:
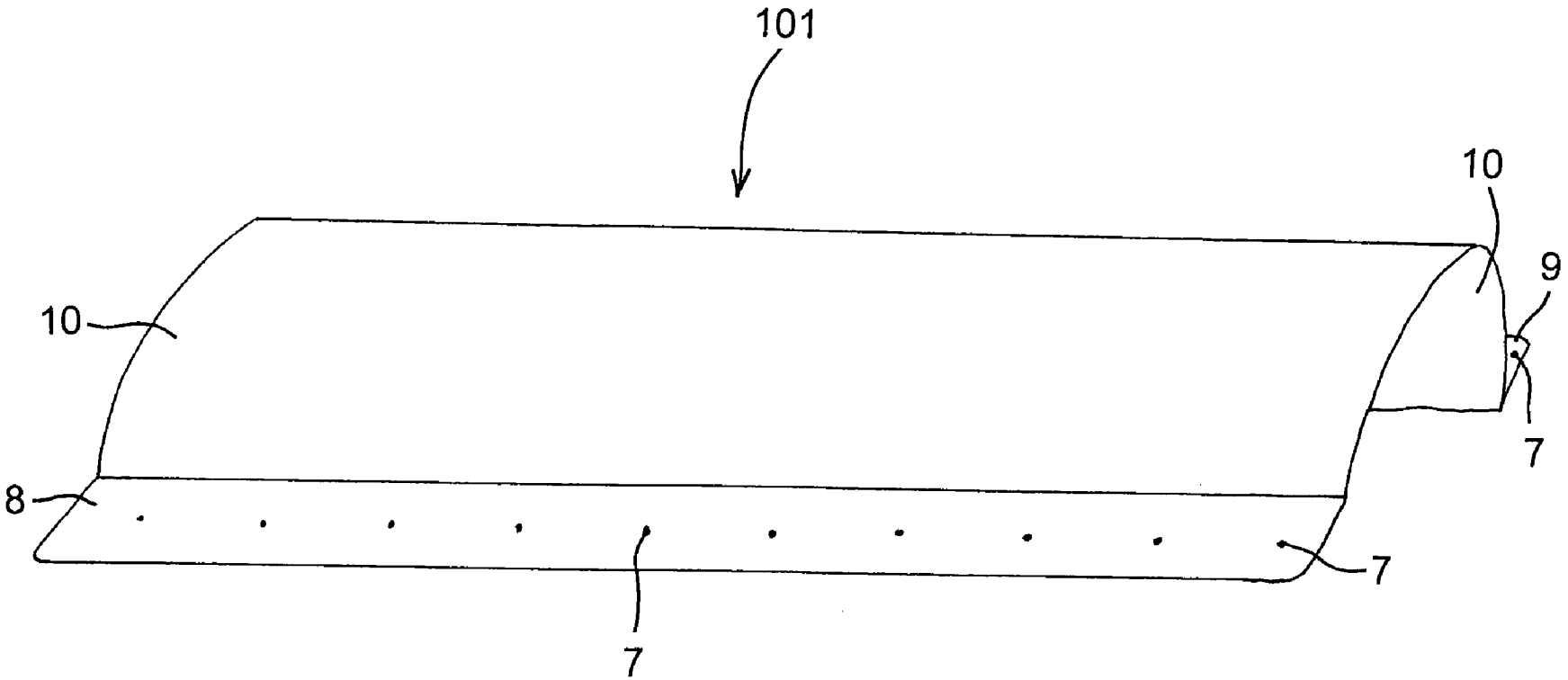
FIG. 9 shows a rounded roof protecting element according to one possible embodiment.
Figure 9A:
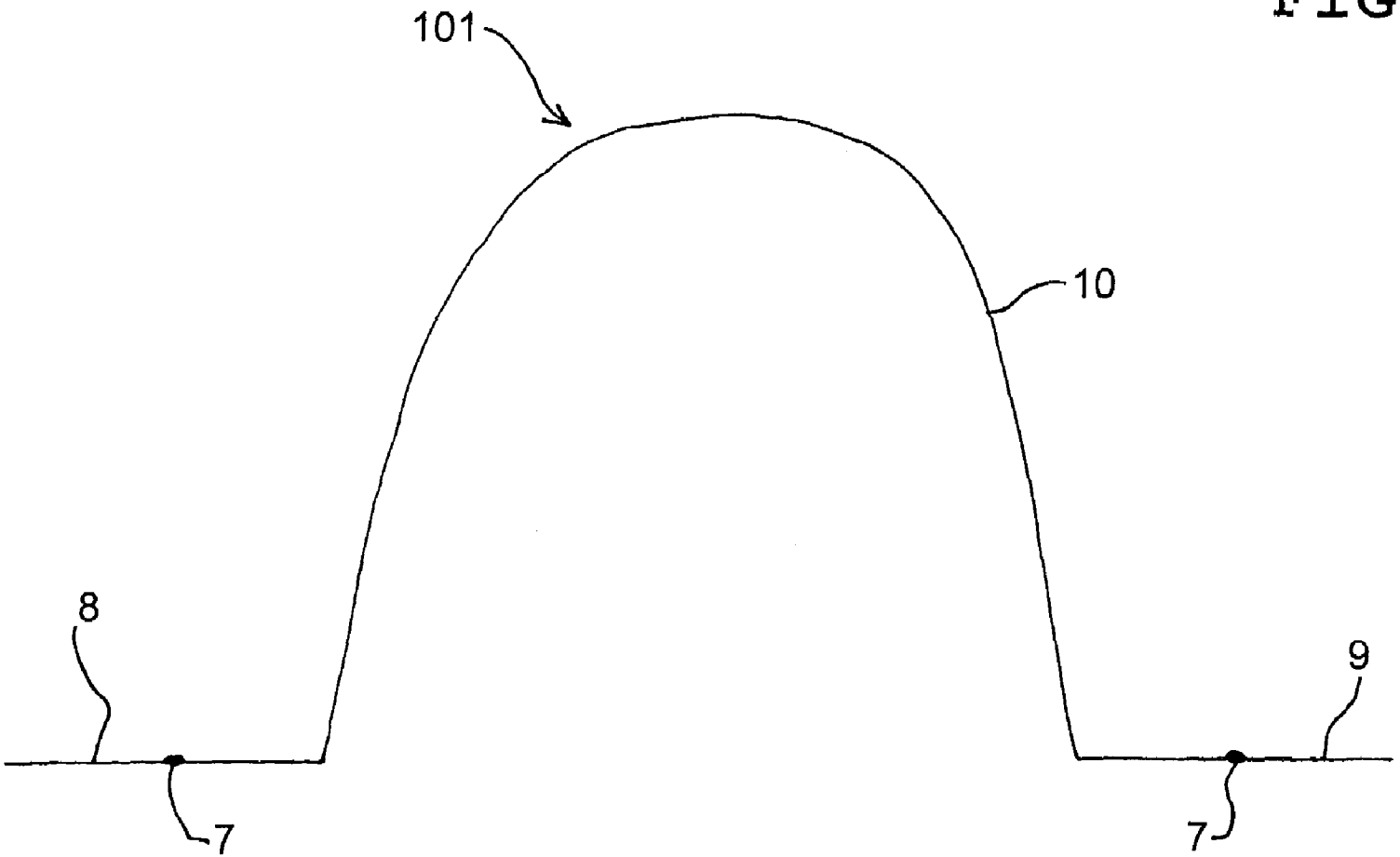
FIG. 9A shows a cross-section of a rounded roof protecting element according to one possible embodiment.

FIGS. 9 and 9A show the main components of one possible embodiment of a roof protecting element, specifically, a roof protecting element used as a wind deflection system to reduce the lift factor of high winds including hurricane winds on a building with a roof, in accordance with at least one possible embodiment, in which system could possibly be utilized at least one aspect, or several aspects, of the embodiments disclosed herein.

FIGS. 9 and 9A show a roof protecting element 101 with flange 8 and 9 and curved cover feature 10. The curved cover feature 10 is shown to be supported by the flange 8 and 9, and the flange 8 and 9 are shown to have several securing points 7. In one possible embodiment, the securing point 7 is the site at which the roof protecting element 101 may be attached to the roof of a building.

In one possible embodiment, the flange 8 and 9 and the curved cover feature 10 of the roof protecting element 101 have a length and a width measurement, with the length measurement being substantially greater than the width measurement.

In one possible embodiment, the length measurement of the flange 8 and 9 and the curved cover feature 10 of the roof protecting element 101 is approximately eight feet.

In other possible embodiments, the length measurement of the flange 8 and 9 and the curved cover feature 10 may be any number of lengths. In other possible embodiments, the length measurement of the flange 8 and 9 and the curved cover feature 10 may be any number of 1-inch increments larger than twelve inches and less than twenty feet.

In one possible embodiment, the width measurement of the flange 8 and 9 of the roof protecting element 101 is approximately two inches.

In other possible embodiments, the width measurement of the flanges 1 and 2 and the cover section 5 may be any number of widths.

In other possible embodiments, the width measurement of the flanges 1 and 2 and the cover section 5 may be approximately any number of one thirty-second of an inch increments larger than zero inches and less than twelve inches.

In one possible embodiment, the width measurement of the curved cover feature 10 of the roof protecting element 101 is approximately twelve inches.

In other possible embodiments, the width measurement of the curved cover feature 10 may be any number of widths.

In other possible embodiments, the width measurement of the curved cover feature 10 may be approximately any number of one thirty-second of an inch increments larger than zero inches and less than four feet.

In other possible embodiments, one or more of the flange 8 and 9 and curved cover feature 10 of the roof protecting element 101 may be used in several or a multiplicity of length measurements and/or several or a multiplicity of width measurements, or the same length and width measurements may be used repeatedly.

In FIG. 9A, the width dimension of the curved cover feature 10 is shown to be rounded, with the approximate center point of the width dimension being the highest point in the curve in respect to the flange 8 and 9.

Other possible embodiments may position the rounded width dimension of the curved cover feature 10 in such a way that the approximate center point of the rounded width dimension of the curved cover feature 10 may not be the highest point in the curve in respect to the flange 8 and 9.

In FIG. 9A, the rounded width dimension of the curved cover feature 10 is shown to be at an approximate 90-degree angle with respect to the width dimension of the flange 8 and 9.

Other possible embodiments may position the rounded width dimension of the curved cover feature 10 at any number of 1-degree increments larger than zero degrees and less than one hundred and eighty degrees with respect to the width dimension of the flange 8 and 9.

In other possible embodiments, one or more of width dimensions of the flanges 1 and 2, inclined face section 3, supporting back section 4, and cover section 5 of the roof protecting element 101 may be used in several or a multiplicity of angles with respect to each of the other components of the roof protecting element 1011, or the same angles may be used repeatedly.

Figure 10:
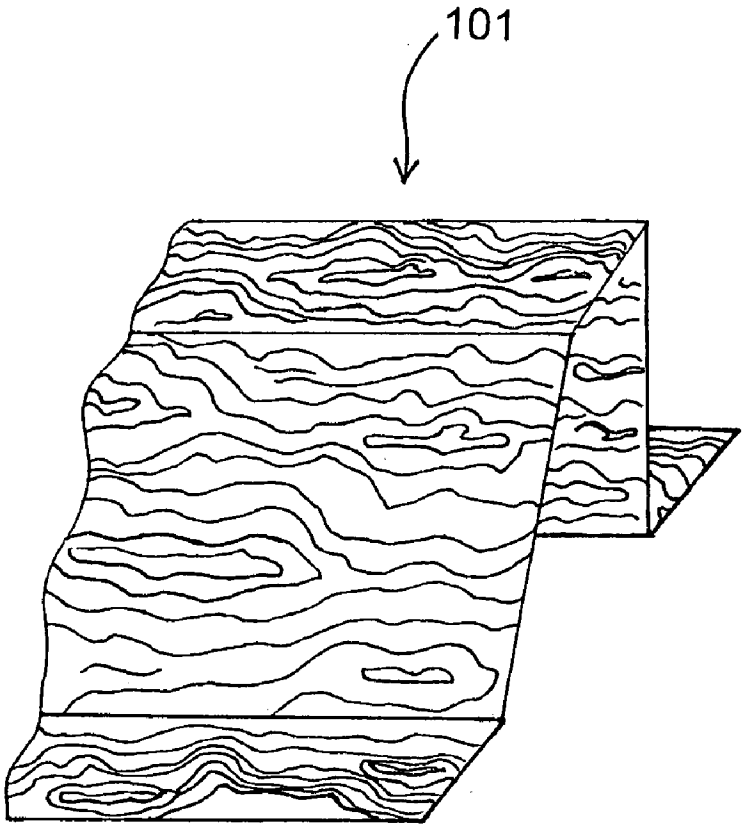
FIG. 10 shows a portion of a roof protecting element which is constructed or fashioned out of a wood-based or wood-like material according to one possible embodiment.

FIG. 10 shows a portion of one possible embodiment of a roof protecting element, specifically, a roof protecting element used as a wind deflection system, in accordance with at least one possible embodiment, in which system could possibly be utilized at least one aspect, or several aspects, of the embodiments disclosed herein.

FIG. 10 shows a portion of one possible embodiment of a roof protecting element 101, which is constructed or fashioned out of a wood-based or wood-like material. In other possible embodiments, a roof protecting element 101 may be produced in numerous other materials.

In other possible embodiments, a roof protecting element 101 may be produced in numerous other materials which may be beneficial in deflecting wind and reducing the lift factor of high winds including hurricane winds.

In other possible embodiments, the roof protecting element 101 may be produced in numerous other materials, such as: metal-based or metal-like, plastic-based or plastic-like, and/or other naturally-occurring or man-made materials.

In other possible embodiments, the roof protecting element 101 may be produced in several or a multiplicity of materials, such as: metal-based or metal-like, plastic-based or plastic-like, and/or other naturally-occurring or man-made materials.

In other possible embodiments, the roof protecting element 101 may be produced in several or a multiplicity of materials and in several or a multiplicity of combinations.

Figure 11:
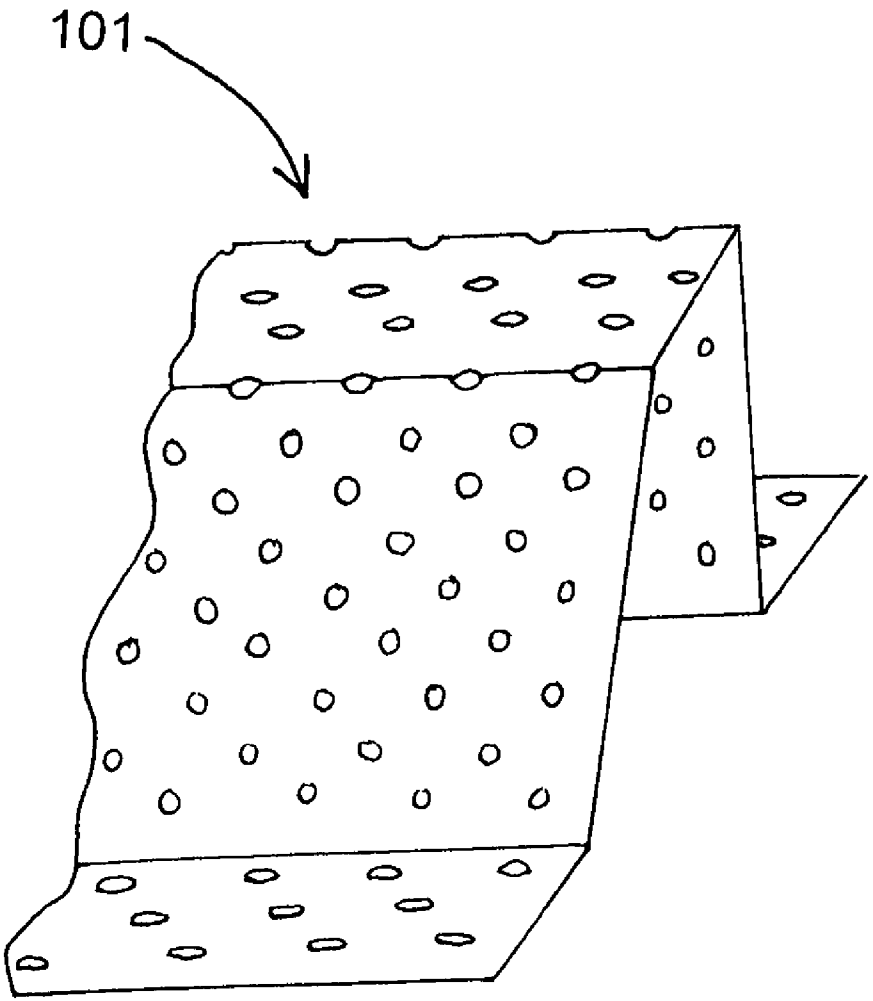
FIG. 11 shows a portion of a roof protecting element which is constructed or fashioned out of a metal-based or metal-like material according to one possible embodiment.

FIG. 11 shows a portion of one possible embodiment of a roof protecting element, specifically, a roof protecting element used as a wind deflection system, in accordance with at least one possible embodiment, in which system could possibly be utilized at least one aspect, or several aspects, of the embodiments disclosed herein.

FIG. 11 shows a portion of one possible embodiment of a roof protecting element 101, which is constructed or fashioned out of a metal-based or metal-like material. In other possible embodiments, a roof protecting element 101 may be produced in numerous other materials.

FIG. 11 shows a portion of one possible embodiment of the roof protecting element 101, which is constructed or fashioned out of a metal-based or metal-like. In other possible embodiments, a roof protecting element 101 may be produced in numerous other textures.

In other possible embodiments, the roof protecting element 37 may be produced in numerous other textures which may be beneficial in deflecting wind and reducing the lift factor of high winds including hurricane winds.

FIGS. 12, 13, 14, and 15 each show a portion of a cross-section of a possible embodiment of a roof protecting element 101, specifically, a roof protecting element used as a wind deflection system, in accordance with at least one possible embodiment, in which system could possibly be utilized at least one aspect, or several aspects, of the embodiments disclosed herein.

FIGS. 12, 13, 14, and 15 each show a portion of a cross-section of a possible embodiment of the roof protecting element 101, which has various possible surface textures. In other possible embodiments, a roof protecting element 101 may be produced in numerous other surface textures.

Figure 12:
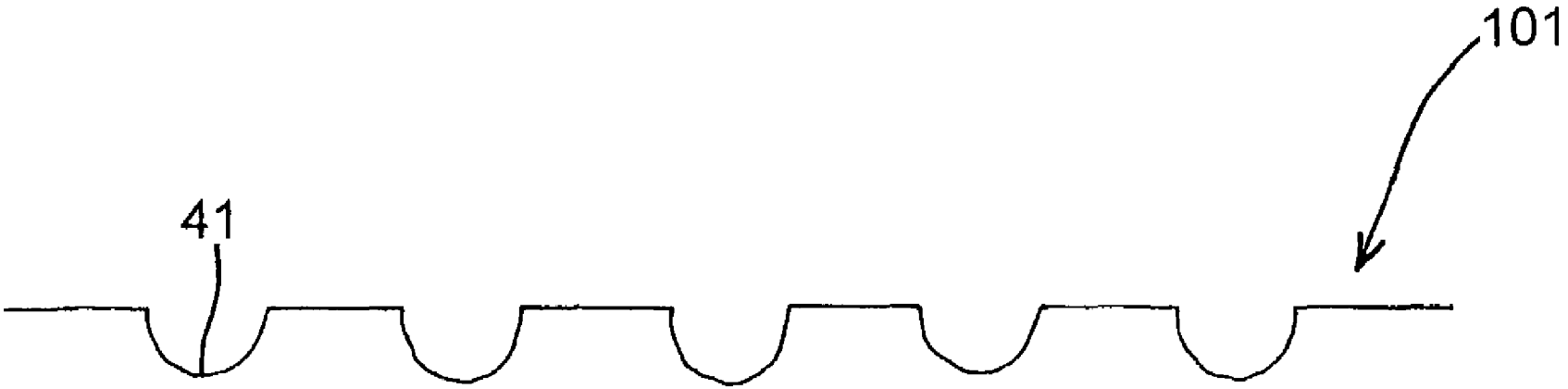
FIG. 12 shows a portion of a cross-section of a roof protecting element, which has an inverted-dimple surface according to one possible embodiment.
Figure 13:
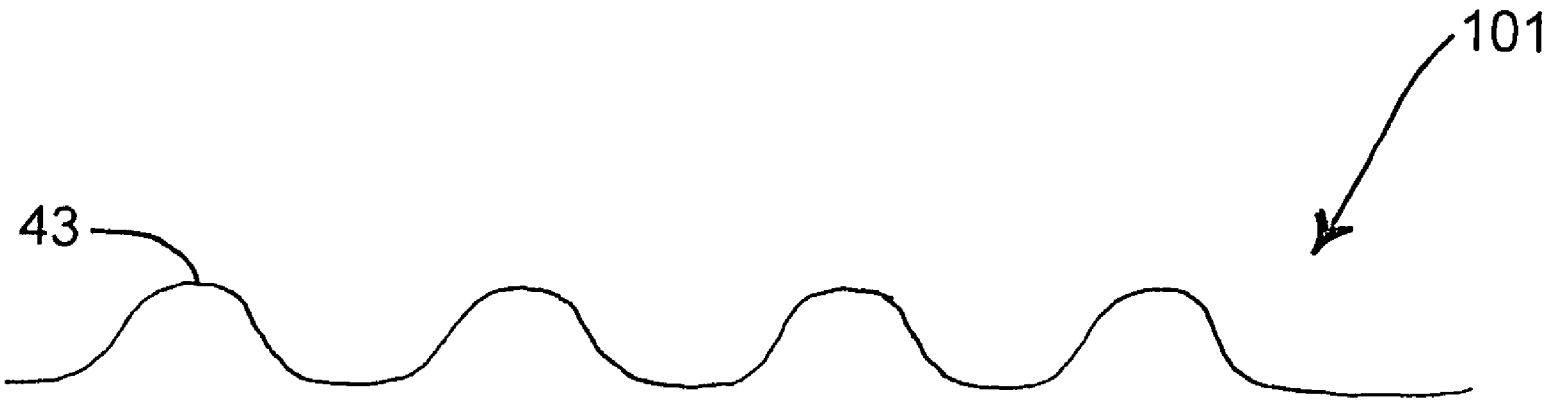
FIG. 13 shows a portion of a cross-section of a roof protecting element, which has a rounded raised-channel surface according to one possible embodiment.
Figure 14:
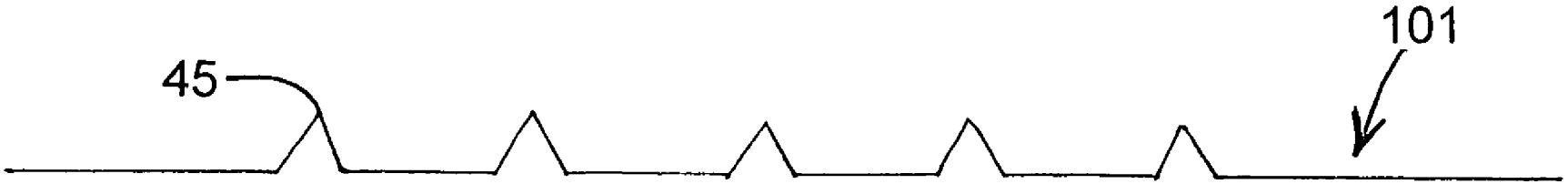
FIG. 14 shows a portion of a cross-section of a roof protecting element, which has a triangular raised-channel surface according to one possible embodiment.
Figure 15:
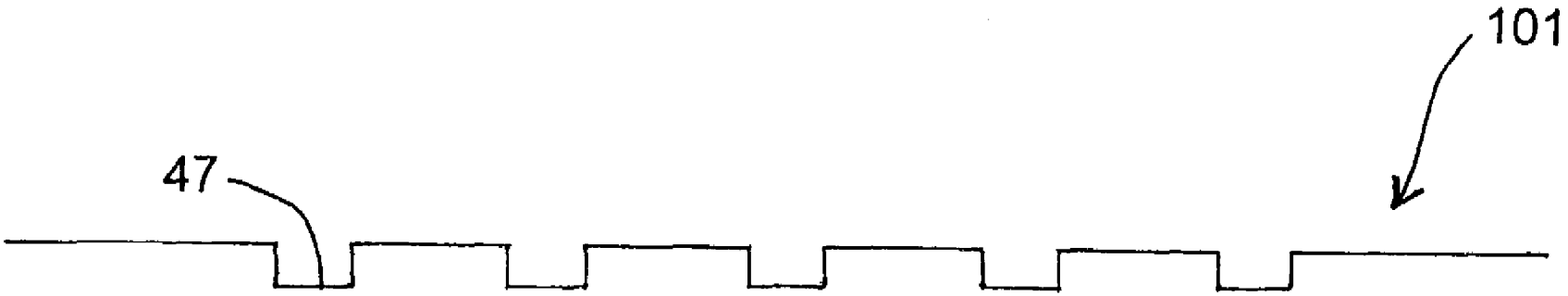
FIG. 15 shows a portion of a cross-section of a roof protecting element, which has a squared inverted-channel surface according to one possible embodiment.

FIG. 12 shows a portion of a cross-section of one possible embodiment of a roof protecting element 101, which has an inverted-dimple surface 41. FIG. 13 shows a portion of a cross-section of one possible embodiment of a roof protecting element 101, which has a rounded raised-channel surface 43. FIG. 14 shows a portion of a cross-section of one possible embodiment of a roof protecting element 101, which has a triangular raised-channel surface 45. FIG. 15 shows a portion of a cross-section of one possible embodiment of a roof protecting element 101, which has a squared inverted-channel surface 47.

In other possible embodiments, a roof protecting element 101 may be produced in numerous other surface textures.

In other possible embodiments, a roof protecting element 101 may be produced in numerous other textures which may be beneficial in deflecting wind and reducing the lift factor of high winds including hurricane winds.

In other possible embodiments, a roof protecting element 101 may be produced in numerous other textures, such as: woven, smooth, rough, spiked, raised, or channeled.

In other possible embodiments, a roof protecting element 101 may be produced in several or a multiplicity of textures, such as: woven, smooth, rough, spiked, raised, or channeled.

In other possible embodiments, a roof protecting element 101 may be produced in several or a multiplicity of textures and in several or a multiplicity of combinations.

Figure 16:
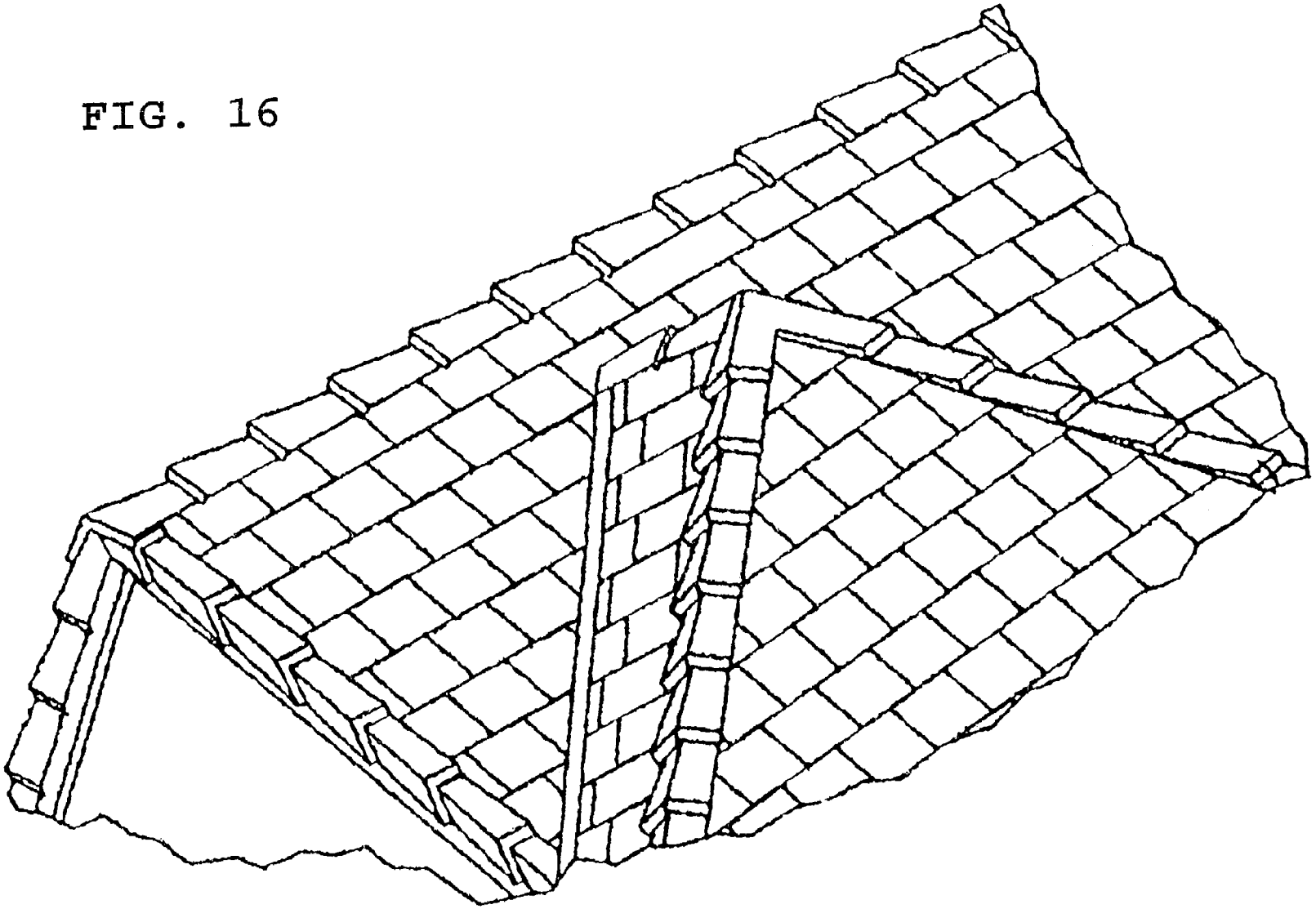
FIG. 16 shows a possible example of a pitched roof that may be fitted with a roof protecting element, specifically, a roof protecting element used as a wind deflection system, in accordance with at least one possible embodiment, in which system at least one aspect, or several aspects, of the embodiments disclosed herein could possibly be utilized.

FIG. 16 shows a possible embodiment of a pitched roof that may be fitted with a roof protecting element 101, specifically, a roof protecting element used as a wind deflection system, in accordance with at least one possible embodiment, in which system could possibly be utilized at least one aspect, or several aspects, of the embodiments disclosed herein.

Figure 17:
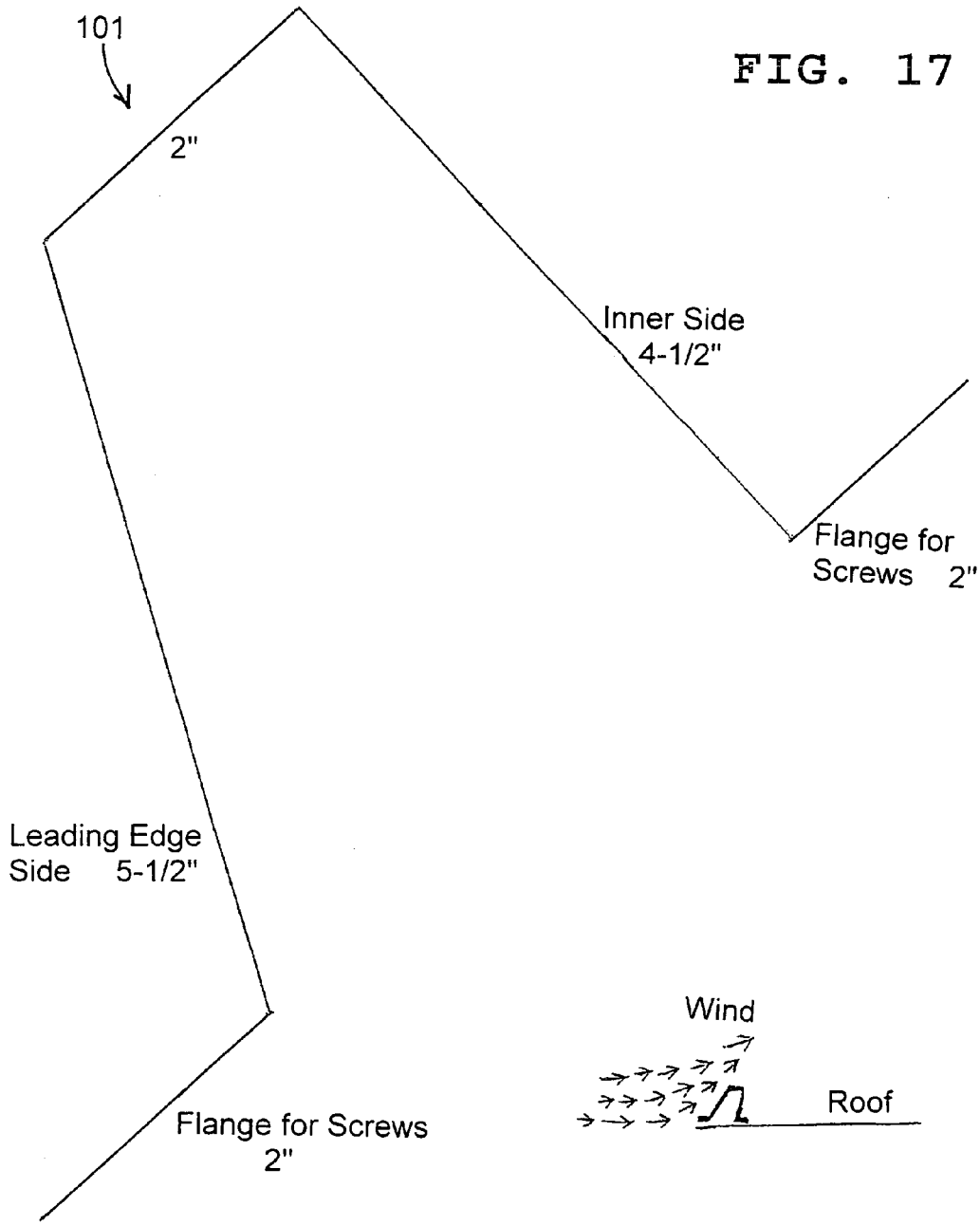
FIG. 17 shows one possible embodiment of a roof protecting element, specifically, a roof protecting element used as a wind deflection system, in which system at least one aspect, or several aspects, of the embodiments disclosed herein could possibly be utilized.

FIG. 17 shows a possible embodiment of a roof protecting element 101, specifically, a roof protecting element used as a wind deflection system, in accordance with at least one possible embodiment, in which system could possibly be utilized at least one aspect, or several aspects, of the embodiments disclosed herein.

One feature or aspect of an embodiment is believed at the time of the filing of this patent application to possibly reside broadly in building, said building comprising: walls and a foundation structure configured and disposed to support said walls; a roof comprising: a roof support arrangement; an outer roof surface; at least one wind deflector being disposed on said outer roof surface; said at least one wind deflector having a length dimension and a width dimension, said length dimension being greater than said width dimension; said at least one wind deflector comprises material with a minimized thickness, to minimize the weight and amount of material; a first outer surface, a second outer surface and a third outer surface; a first inner surface, a second inner surface and a third inner surface opposite said outer surfaces; said first outer surface having a first portion and a second portion; said first portion of said first outer surface being disposed adjacent said outer roof surface; said second portion of said first outer surface being disposed a distance away from said first portion of said first outer surface; said first outer surface being disposed at an obtuse angle substantially greater than a right angle with respect to said outer roof surface; said third outer surface having a first and second portion; said first portion of said third outer surface being disposed adjacent said outer roof surface; said second portion of said third outer surface being disposed a distance away from said first portion of said third outer surface; said third outer surface being disposed at a substantially right angle with respect to said outer roof surface; said second outer surface being disposed between and to connect said first outer surface and said third outer surface; said second outer surface having a first portion and a second portion; said first portion of said second outer surface being disposed adjacent said second portion of said first outer surface; said second portion of said second outer surface being disposed a distance away from said first portion of said second outer surface and being disposed adjacent said second portion of said third outer surface; said first inner surface having a first portion and a second portion; said first portion of said first inner surface being disposed adjacent said outer roof surface; said second portion of said first inner surface being disposed a distance away from said first portion; said first inner surface being disposed at an acute angle substantially less than a right angle with respect to said outer roof surface; said third inner surface having a first portion and a second portion; said first portion of said third inner surface being disposed adjacent said outer roof surface; said second portion of said third inner surface being disposed a distance away from said first portion of said third inner surface; said third inner surface being disposed at a substantially right angle with respect to said outer roof surface; said second inner surface being disposed between and to connect said first inner surface and said third inner surface; said second inner surface having a first portion and a second portion; said first portion of said second inner surface being disposed adjacent said second portion of said first inner surface; said second portion of said second inner surface being disposed a distance away from said first portion of said second inner surface and being disposed adjacent said second portion of said third inner surface; said second inner surface being disposed at an obtuse angle substantially greater than a right angle with respect to said first inner surface; said second inner surface being disposed at a substantially right angle with respect to said third inner surface; a first flange and second flange; said first flange extending along and in the plane of said outer roof surface; said first flange being connected to and being disposed to extend from said first portion of said first outer surface; said first flange being disposed at a substantially obtuse angle with respect to said first outer surface; said second flange extending along and in the plane of said outer roof surface; said second flange being connected to said first portion of said third outer surface; said second flange being disposed at a substantially right angle with respect to said third outer surface; fastening devices, such as screws or nails, being configured and disposed to fasten said first and second flanges to said outer roof surface; said at least one wind deflector being configured to interrupt at least any laminar flow of wind over said deflector and increase turbulent flow of wind over said deflector to reduce lifting effect of wind flowing over said outer roof surface.

Another feature or aspect of an embodiment is believed at the time of the filing of this patent application to possibly reside broadly in the building, wherein said at least one wind deflector comprises a plurality of wind deflectors.

Yet another feature or aspect of an embodiment is believed at the time of the filing of this patent application to possibly reside broadly in the building, wherein said wind deflectors being substantially parallel to one another.

Still another feature or aspect of an embodiment is believed at the time of the filing of this patent application to possibly reside broadly in the building, wherein said wind deflectors are non-parallel and disposed at substantial angles with respect to one another.

A further feature or aspect of an embodiment is believed at the time of the filing of this patent application to possibly reside broadly in the building, wherein said wind deflectors are of different lengths.

Another feature or aspect of an embodiment is believed at the time of the filing of this patent application to possibly reside broadly in the building, wherein said wind deflectors being substantially parallel to one another.

Yet another feature or aspect of an embodiment is believed at the time of the filing of this patent application to possibly reside broadly in the building, wherein the surface of said at least one wind deflector having one height extending from surface and having another height less than first height to substantially increase turbulent flow over said outer roof surface.

Still another feature or aspect of an embodiment is believed at the time of the filing of this patent application to possibly reside broadly in a roof on a building having walls and a foundation structure configured and disposed to support said walls; said roof comprising: a roof support arrangement; an outer roof surface; at least one wind deflector being disposed on said outer roof surface; said at least one wind deflector having a length dimension and a width dimension, said length dimension being greater than said width dimension; said at least one wind deflector comprises a material with a minimized thickness, to minimize the weight and amount of material; said at least one wind deflector comprising: a first outer surface, a second outer surface and a third outer surface; and a first inner surface, a second inner surface and a third inner surface opposite said outer surfaces; said first outer surface having a first portion and a second portion; said first portion of said first outer surface being disposed at least substantially adjacent said outer roof surface; said second portion said first outer surface being disposed away from said first portion said first outer surface; said third outer surface having a first and second portion; said first portion of said third outer surface being disposed adjacent said outer roof surface; said second portion of said third outer surface being disposed away from said first portion of said third outer surface; said third outer surface being disposed at a substantial angle with respect to said outer roof surface; said second outer surface being disposed between and to connect said first outer surface and said third outer surface; said second outer surface having a first portion and a second portion; said first portion of said second outer surface being disposed adjacent said second portion of said first outer surface; said second portion of said second outer surface being disposed a distance away from said first portion of said second outer surface and being disposed adjacent said second portion of said third outer surface; said first inner surface having a first portion and a second portion; said first portion of said first inner surface being disposed adjacent said outer roof surface; said second portion of said first inner surface being disposed a distance away from said first portion; said first inner surface being disposed at a substantial angle with respect to the outer roof surface; said third inner surface having a first portion and a second portion; said first portion of said third inner surface being disposed adjacent said outer roof surface; said second portion of said third inner surface being disposed a distance away from said first portion of said third inner surface; said third inner surface being disposed at a substantial angle with respect to outer roof surface; said second inner surface being disposed between and to connect said first inner surface and said third inner surface; said second inner surface having a first portion and a second portion; said second portion of said second inner surface being disposed a distance away from said first portion of said second inner surface said second inner surface being disposed at a substantial angle with respect to said first inner surface; said second inner surface being disposed at a substantial angle with respect to said third inner surface; a first and second attachment structure being configured to attach said at least one wind deflector to said outer roof structure; said at least one wind deflector being configured to interrupt any flow of wind over said at least one wind deflector and to reduce lifting effect of wind flowing over said outer roof surface.

A further feature or aspect of an embodiment is believed at the time of the filing of this patent application to possibly reside broadly in the roof, wherein said at least one wind deflector comprises a plurality of wind deflectors.

Another feature or aspect of an embodiment is believed at the time of the filing of this patent application to possibly reside broadly in the roof, wherein said wind deflectors being substantially parallel to one another.

Yet another feature or aspect of an embodiment is believed at the time of the filing of this patent application to possibly reside broadly in the roof, wherein said wind deflectors are non-parallel and disposed at substantial angles with respect to one another.

Still another feature or aspect of an embodiment is believed at the time of the filing of this patent application to possibly reside broadly in the roof, wherein said wind deflectors are of different lengths.

A further feature or aspect of an embodiment is believed at the time of the filing of this patent application to possibly reside broadly in the roof, wherein said wind deflectors being substantially parallel to one another.

Another feature or aspect of an embodiment is believed at the time of the filing of this patent application to possibly reside broadly in the roof, wherein the surface of said at least one wind deflector having one height extending from surface and having another height less than first height may substantially increase turbulent flow over said roof.

Yet another feature or aspect of an embodiment is believed at the time of the filing of this patent application to possibly reside broadly in a method of protecting a building with a roof to reduce lifting effect of wind flowing over the roof of said building: said building having a roof; comprising walls and a foundation structure configured and disposed to support said walls; said roof comprising: a roof support arrangement; an outer roof surface; at least one wind deflector being disposed on said outer roof surface; said at least one wind deflector having a length dimension and a width dimension, said length dimension being greater than said width dimension; said at least one wind deflector comprises a material with a minimized thickness, to minimize the weight and amount of material; said at least one wind deflector comprising: a first outer surface, a second outer surface and a third outer surface; and a first inner surface, a second inner surface and a third inner surface opposite said outer surfaces; said first outer surface having a first portion and a second portion; said first portion of said first outer surface being disposed at least substantially adjacent said outer roof surface; said second portion said first outer surface being disposed away from said first portion said first outer surface; said first outer surface being disposed at an obtuse angle substantially greater than a right angle with respect to said outer roof surface; said third outer surface having a first portion and a second portion; said first portion of said third outer surface being disposed adjacent said outer roof surface; said second portion of said third outer surface being disposed away from said first portion of said third outer surface; said third outer surface being disposed at a substantially right angle with respect to said outer roof surface; said second outer surface being disposed between and to connect said first outer surface and said third outer surface; said second outer surface having a first portion and a second portion; said first portion of said second outer surface being disposed adjacent said second portion of said first outer surface; said second portion of said second outer surface being disposed a distance away from said first portion of said second outer surface and being disposed adjacent said second portion of said third outer surface; said first inner surface having a first portion and a second portion; said first portion of said first inner surface being disposed adjacent said outer roof surface; said second portion of said first inner surface being disposed a distance away from said first portion; said first inner surface being disposed at an acute angle substantially less than a right angle with respect to the outer roof surface; said third inner surface having a first portion and a second portion; said first portion of said third inner surface being disposed adjacent said outer roof surface; said second portion of said third inner surface being disposed a distance away from said first portion of said third inner surface; said third inner surface being disposed at a substantially right angle with respect to outer roof surface; said second inner surface being disposed between and to connect said first inner surface and said third inner surface; said second inner surface having a first portion and a second portion; said second portion of said second inner surface being disposed a distance away from said first portion of said second inner surface and being disposed adjacent said second portion of said third inner surface; said second inner surface being disposed at an obtuse angle substantially greater than a right angle with respect to said first inner surface; said second inner surface being disposed at a substantially right angle with respect to said third inner surface; a first flange and a second flange; said first flange extending along and in the plane of said outer roof surface; said first flange being connected to and being disposed to extend from said first portion of said first outer surface; said first flange being disposed at a substantially obtuse angle with respect to said first outer surface; said second flange extending along and in the plane of said outer roof surface; said second flange being connected to said first portion of said third outer surface; said second flange being disposed at a substantially right angle with respect to said third outer surface; fastening device, such as screws or nails, being configured and disposed to fasten said first and second flanges to said outer roof surface; said at least one wind deflector being configured to interrupt at least any laminar flow of wind over said at least one wind deflector and increase turbulent flow of wind over said at least one wind deflector to reduce lifting effect of wind flowing over said roof of building; said method comprising the steps of: installing said at least one wind deflector on said outer roof surface; interrupting at least a portion of laminar flow of wind over said at least one wind deflector; increasing turbulent flow of wind over said at least one wind deflector and said roof; and reducing lifting effect of wind flowing over a said roof of said building with said at least one wind deflector.

Still another feature or aspect of an embodiment is believed at the time of the filing of this patent application to possibly reside broadly in the method, wherein said at least one wind deflector comprises a plurality of wind deflectors; said method comprising the further steps of: deflecting at least any laminar flow of wind over said roof with a plurality of said wind deflectors; increasing turbulent flow of wind over said plurality of wind deflectors; and reducing lifting effect of wind flowing over a said roof of said building with said wind deflectors.

A further feature or aspect of an embodiment is believed at the time of the filing of this patent application to possibly reside broadly in the method as claimed in claim 16, wherein said wind deflectors being substantially parallel to one another; said method comprising the further steps of: deflecting at least any laminar flow of wind over said roof with said wind deflectors; increasing turbulent flow of wind over said wind deflectors; and reducing lifting effect of wind flowing over a said roof of said building with said wind deflectors.

Another feature or aspect of an embodiment is believed at the time of the filing of this patent application to possibly reside broadly in the method, wherein said wind deflectors are non-parallel and disposed at substantial angles with respect to one another; said method comprising the further steps of: deflecting at least any laminar flow of wind over said roof with said wind deflectors; increasing turbulent flow of wind over said wind deflectors; and reducing lifting effect of wind flowing from a plurality of wind directions over a said roof of said building with said wind deflectors.

Yet another feature or aspect of an embodiment is believed at the time of the filing of this patent application to possibly reside broadly in the method, wherein said wind deflectors are of different lengths, providing different interruptions of wind over said wind deflectors; said method comprising the further steps of: deflecting at least any laminar flow of wind over said roof with said wind deflectors; increasing turbulent flow of wind over said deflectors; and reducing lifting effect of wind flowing from a plurality of wind directions over a said roof of said building with said wind deflectors.

Still another feature or aspect of an embodiment is believed at the time of the filing of this patent application to possibly reside broadly in the method, wherein the surface of said at least one wind deflector having heights extending from said at least one wind deflector and having other heights less than first heights to substantially increase turbulent flow over said roof with said at least one wind deflector; said heights comprising at least one of: said material having holes in said at least one wind deflector; said material having dimples in said at least one wind deflector; said material having channels in said at least one wind deflector; said material having several or a multiplicity of textures in said at least one wind deflector; said method comprising the further steps of: deflecting at least any laminar flow of wind over said roof with said heights on said at least one wind deflector; increasing turbulent flow of wind over said at least one wind deflector with said heights; and reducing lifting effect of wind flowing from a plurality of wind directions over a said roof of said building with said heights on said at least one wind deflector.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the embodiments of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A building, said building comprising:

walls and a foundation structure configured and disposed to support said walls;

a roof comprising:

a roof support arrangement;

an outer roof surface;

at least one wind deflector being disposed on said outer roof surface;

said at least one wind deflector having a length dimension and a width dimension, said length dimension being greater than said width dimension;

said at least one wind deflector comprises material with a minimized thickness, to minimize the weight and amount of material;

a first outer surface, a second outer surface and a third outer surface;

a first inner surface, a second inner surface and a third inner surface opposite said outer surfaces;

said first outer surface having a first portion and a second portion;

said first portion of said first outer surface being disposed adjacent said outer roof surface;

said second portion of said first outer surface being disposed a distance away from said first portion of said first outer surface;

said first outer surface being disposed at an obtuse angle substantially greater than a right angle with respect to said outer roof surface;

said third outer surface having a first and second portion;

said first portion of said third outer surface being disposed adjacent said outer roof surface;

said second portion of said third outer surface being disposed a distance away from said first portion of said third outer surface;

said third outer surface being disposed at a substantially right angle with respect to said outer roof surface;

said second outer surface being disposed between and to connect said first outer surface and said third outer surface;

said second outer surface having a first portion and a second portion;

said first portion of said second outer surface being disposed adjacent said second portion of said first outer surface;

said second portion of said second outer surface being disposed a distance away from said first portion of said second outer surface and being disposed adjacent said second portion of said third outer surface;

said first inner surface having a first portion and a second portion;

said first portion of said first inner surface being disposed adjacent said outer roof surface;

said second portion of said first inner surface being disposed a distance away from said first portion;

said first inner surface being disposed at an acute angle substantially less than a right angle with respect to said outer roof surface;

said third inner surface having a first portion and a second portion;

said first portion of said third inner surface being disposed adjacent said outer roof surface;

said second portion of said third inner surface being disposed a distance away from said first portion of said third inner surface;

said third inner surface being disposed at a substantially right angle with respect to said outer roof surface;

said second inner surface being disposed between and to connect said first inner surface and said third inner surface;

said second inner surface having a first portion and a second portion;

said first portion of said second inner surface being disposed adjacent said second portion of said first inner surface;

said second portion of said second inner surface being disposed a distance away from said first portion of said second inner surface and being disposed adjacent said second portion of said third inner surface;

said second inner surface being disposed at an obtuse angle substantially greater than a right angle with respect to said first inner surface;

said second inner surface being disposed at a substantially right angle with respect to said third inner surface;

a first flange and second flange;

said first flange extending along and in the plane of said outer roof surface;

said first flange being connected to and being disposed to extend from said first portion of said first outer surface;

said first flange being disposed at a substantially obtuse angle with respect to said first outer surface;

said second flange extending along and in the plane of said outer roof surface;

said second flange being connected to said first portion of said third outer surface;

said second flange being disposed at a substantially right angle with respect to said third outer surface;

fastening devices, such as screws or nails, being configured and disposed to fasten said first and second flanges to said outer roof surface;

said at least one wind deflector being configured to interrupt at least any laminar flow of wind over said deflector and increase turbulent flow of wind over said deflector to reduce lifting effect of wind flowing over said outer roof surface.

2. The building as claimed in claim 1, wherein said at least one wind deflector comprises a plurality of wind deflectors.

3. The building as claimed in claim 2, wherein said wind deflectors being substantially parallel to one another.

4. The building as claimed in claim 2, wherein said wind deflectors are non-parallel and disposed at substantial angles with respect to one another.

5. The building as claimed in claim 2, wherein said wind deflectors are of different lengths.

6. The building as claimed in claim 5, wherein said wind deflectors being substantially parallel to one another.

7. The building as claimed in claim 1, wherein the surface of said at least one wind deflector having one height extending from surface and having another height less than first height to substantially increase turbulent flow over said outer roof surface.

8. A roof on a building having walls and a foundation structure configured and disposed to support said walls;

said roof comprising:

a roof support arrangement;

an outer roof surface;

at least one wind deflector being disposed on said outer roof surface;

said at least one wind deflector having a length dimension and a width dimension, said length dimension being greater than said width dimension;

said at least one wind deflector comprises a material with a minimized thickness, to minimize the weight and amount of material;

said at least one wind deflector comprising:

a first outer surface, a second outer surface and a third outer surface; and a first inner surface, a second inner surface and a third inner surface opposite said outer surfaces;

said first outer surface having a first portion and a second portion;

said first portion of said first outer surface being disposed at least substantially adjacent said outer roof surface;

said second portion said first outer surface being disposed away from said first portion said first outer surface;

said third outer surface having a first and second portion;

said first portion of said third outer surface being disposed adjacent said outer roof surface;

said second portion of said third outer surface being disposed away from said first portion of said third outer surface;

said third outer surface being disposed at a substantial angle with respect to said outer roof surface;

said second outer surface being disposed between and to connect said first outer surface and said third outer surface;

said second outer surface having a first portion and a second portion;

said first portion of said second outer surface being disposed adjacent said second portion of said first outer surface;

said second portion of said second outer surface being disposed a distance away from said first portion of said second outer surface and being disposed adjacent said second portion of said third outer surface;

said first inner surface having a first portion and a second portion;

said first portion of said first inner surface being disposed adjacent said outer roof surface;

said second portion of said first inner surface being disposed a distance away from said first portion;

said first inner surface being disposed at a substantial angle with respect to the outer roof surface;

said third inner surface having a first portion and a second portion;

said first portion of said third inner surface being disposed adjacent said outer roof surface;

said second portion of said third inner surface being disposed a distance away from said first portion of said third inner surface;

said third inner surface being disposed at a substantial angle with respect to outer roof surface;

said second inner surface being disposed between and to connect said first inner surface and said third inner surface;

said second inner surface having a first portion and a second portion;

said second portion of said second inner surface being disposed a distance away from said first portion of said second inner surface said second inner surface being disposed at a substantial angle with respect to said first inner surface;

said second inner surface being disposed at a substantial angle with respect to said third inner surface;

a first and second attachment structure being configured to attach said at least one wind deflector to said outer roof structure;

said at least one wind deflector being configured to interrupt any flow of wind over said at least one wind deflector and to reduce lifting effect of wind flowing over said outer roof surface.

9. The roof as claimed in claim 8, wherein said at least one wind deflector comprises a plurality of wind deflectors.

10. The roof as claimed in claim 9, wherein said wind deflectors being substantially parallel to one another.

11. The roof as claimed in claim 9, wherein said wind deflectors are non-parallel and disposed at substantial angles with respect to one another.

12. The roof as claimed in claim 9, wherein said wind deflectors are of different lengths.

13. The roof as claimed in claim 12, wherein said wind deflectors being substantially parallel to one another.

14. The roof as claimed in claim 8, wherein the surface of said at least one wind deflector having one height extending from surface and having another height less than first height may substantially increase turbulent flow over said roof.

15. A method of protecting a building with a roof to reduce lifting effect of wind flowing over the roof of said building:

said building having a roof; comprising walls and a foundation structure configured and disposed to support said walls;

said roof comprising:

a roof support arrangement;

an outer roof surface;

at least one wind deflector being disposed on said outer roof surface;

said at least one wind deflector having a length dimension and a width dimension, said length dimension being greater than said width dimension;

said at least one wind deflector comprises a material with a minimized thickness, to minimize the weight and amount of material;

said at least one wind deflector comprising:

a first outer surface, a second outer surface and a third outer surface; and a first inner surface, a second inner surface and a third inner surface opposite said outer surfaces;

said first outer surface having a first portion and a second portion;

said first portion of said first outer surface being disposed at least substantially adjacent said outer roof surface;

said second portion said first outer surface being disposed away from said first portion said first outer surface;

said first outer surface being disposed at an obtuse angle substantially greater than a right angle with respect to said outer roof surface;

said third outer surface having a first portion and a second portion;

said first portion of said third outer surface being disposed adjacent said outer roof surface;

said second portion of said third outer surface being disposed away from said first portion of said third outer surface;

said third outer surface being disposed at a substantially right angle with respect to said outer roof surface;

said second outer surface being disposed between and to connect said first outer surface and said third outer surface;

said second outer surface having a first portion and a second portion;

said first portion of said second outer surface being disposed adjacent said second portion of said first outer surface;

said second portion of said second outer surface being disposed a distance away from said first portion of said second outer surface and being disposed adjacent said second portion of said third outer surface;

said first inner surface having a first portion and a second portion;

said first portion of said first inner surface being disposed adjacent said outer roof surface;

said second portion of said first inner surface being disposed a distance away from said first portion;

said first inner surface being disposed at an acute angle substantially less than a right angle with respect to the outer roof surface;

said third inner surface having a first portion and a second portion;

said first portion of said third inner surface being disposed adjacent said outer roof surface;

said second portion of said third inner surface being disposed a distance away from said first portion of said third inner surface;

said third inner surface being disposed at a substantially right angle with respect to outer roof surface;

said second inner surface being disposed between and to connect said first inner surface and said third inner surface;

said second inner surface having a first portion and a second portion;

said second portion of said second inner surface being disposed a distance away from said first portion of said second inner surface and being disposed adjacent said second portion of said third inner surface;

said second inner surface being disposed at an obtuse angle substantially greater than a right angle with respect to said first inner surface;

said second inner surface being disposed at a substantially right angle with respect to said third inner surface;

a first flange and a second flange;

said first flange extending along and in the plane of said outer roof surface;

said first flange being connected to and being disposed to extend from said first portion of said first outer surface;

said first flange being disposed at a substantially obtuse angle with respect to said first outer surface;

said second flange extending along and in the plane of said outer roof surface;

said second flange being connected to said first portion of said third outer surface;

said second flange being disposed at a substantially right angle with respect to said third outer surface;

fastening device, such as screws or nails, being configured and disposed to fasten said first and second flanges to said outer roof surface;

said at least one wind deflector being configured to interrupt at least any laminar flow of wind over said at least one wind deflector and increase turbulent flow of wind over said at least one wind deflector to reduce lifting effect of wind flowing over said roof of building;

said method comprising the steps of:

installing said at least one wind deflector on said outer roof surface;

interrupting at least a portion of laminar flow of wind over said at least one wind deflector;

increasing turbulent flow of wind over said at least one wind deflector and said roof; and reducing lifting effect of wind flowing over a said roof of said building with said at least one wind deflector.

16. The method as claimed in claim 15, wherein said at least one wind deflector comprises a plurality of wind deflectors;

said method comprising the further steps of:

deflecting at least any laminar flow of wind over said roof with a plurality of said wind deflectors;

increasing turbulent flow of wind over said plurality of wind deflectors; and reducing lifting effect of wind flowing over a said roof of said building with said wind deflectors.

17. The method as claimed in claim 16, wherein said wind deflectors being substantially parallel to one another;

said method comprising the further steps of:

deflecting at least any laminar flow of wind over said roof with said wind deflectors;

increasing turbulent flow of wind over said wind deflectors; and reducing lifting effect of wind flowing over a said roof of said building with said wind deflectors.

18. The method as claimed in claim 16, wherein said wind deflectors are non-parallel and disposed at substantial angles with respect to one another;

said method comprising the further steps of:

deflecting at least any laminar flow of wind over said roof with said wind deflectors;

increasing turbulent flow of wind over said wind deflectors; and reducing lifting effect of wind flowing from a plurality of wind directions over a said roof of said building with said wind deflectors.

19. The method as claimed in claim 16, wherein said wind deflectors are of different lengths, providing different interruptions of wind over said wind deflectors;

said method comprising the further steps of:

deflecting at least any laminar flow of wind over said roof with said wind deflectors;

increasing turbulent flow of wind over said deflectors; and reducing lifting effect of wind flowing from a plurality of wind directions over a said roof of said building with said wind deflectors.

20. The method as claimed in claim 15, wherein the surface of said at least one wind deflector having heights extending from said at least one wind deflector and having other heights less than first heights to substantially increase turbulent flow over said roof with said at least one wind deflector;

said heights comprising at least one of:

said material having holes in said at least one wind deflector;

said material having dimples in said at least one wind deflector;

said material having channels in said at least one wind deflector;

said material having several or a multiplicity of textures in said at least one wind deflector;

said method comprising the further steps of:

deflecting at least any laminar flow of wind over said roof with said heights on said at least one wind deflector;

increasing turbulent flow of wind over said at least one wind deflector with said heights; and reducing lifting effect of wind flowing from a plurality of wind directions over a said roof of said building with said heights on said at least one wind deflector.

* * * * *